United States Patent [19]

Kaneko et al.

[11] 4,030,571

[45] June 21, 1977

[54] ELEVATOR CONTROL SYSTEM

[75] Inventors: Takashi Kaneko; Takeo Yuminaka; Tatsuo Iwasaka; Hiroshi Kinoshita, all of Katsuta, Japan

[73] Assignee: Hitachi, Ltd., Japan

[22] Filed: Apr. 18, 1975

[21] Appl. No.: 569,401

[30] Foreign Application Priority Data

Apr. 22, 1974 Japan ..... 49-44507
June 5, 1974 Japan ..... 49-62898

[52] U.S. Cl. ..... 187/29 R
[51] Int. Cl.² ..... B66B 1/18
[58] Field of Search ..... 187/29

[56] References Cited

UNITED STATES PATENTS

| | | | |
|---|---|---|---|
| 3,443,668 | 5/1969 | Hall et al. | 187/29 |
| 3,511,342 | 5/1970 | Hall et al. | 187/29 |
| 3,851,733 | 12/1974 | Sackin et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

An elevator control system for controlling a plurality of elevator cars arranged for parallel operation for servicing a plurality of service floor landings of a building, in which means are provided so that, in response to origination of a new hall call in addition to hall calls originated and allotted already, a suitable car for servicing this new hall call can be selected and the new hall call can be allotted to the selected car to be serviced by the selected car. In the system, the change in the service condition of all the cars for the already allotted hall calls due to allotment of this new hall call thereto is taken into account in selecting the suitable car. For example, means are provided for computing for each car the forecast waiting time at each of the already allotted floors to be serviced thereby to detect the change in the forecast waiting time when this new hall call originating floor is serviced. The new hall call is allotted to the car which provides a forecast waiting time less than a predetermined limit, and this car services this specific floor.

15 Claims, 23 Drawing Figures

ELEVATOR CONTROL SYSTEM

This invention relates to an elevator control system for controlling a group of elevator cars, and more particularly to the art of allotment of hall calls to a group of elevator cars controlled by an elevator control system.

In a building in which a plurality of elevator cars are arranged for parallel operation, suitable ones of these elevator cars must be selected to respond to hall calls when such hall calls are originated from some of the floors so that the selected elevator cars can service these floors. Various factors as described below must be taken into consideration in deciding which of the elevator cars should service the floors from which the hall calls are originated. That is, (a) the selected elevator cars can service the specific floors as quickly as possible, (b) a bunch of these elevator cars must not run together in the same direction without any substantial interval therebetween, (c) impossibility of proper service must not occur due to, for example, loading of the selected elevator cars to the full capacity, and (d) the waiting time for the passengers waiting at the individual floors and originating the hall calls must be substantially uniform and as short as possible.

Various methods have heretofore been proposed in an effort to deal with the above problem. According to one of the prior art methods, the physical position of each individual elevator car is detected, and all the hall calls originated from the floors passed by the elevator cars preceding one or some of the elevator cars are allotted to the latter elevator cars. According to another prior art method, all the floors to be seviced by a plurality of elevator cars are divided into a plurality of service zones, and hall calls originated from each individual service zone are allotted to the elevator cars existing in that service zone. Further, the interval between a plurality of elevator cars is controlled in order to prevent a so-called bunch operation in which some of these elevator cars move together in the same direction without any substantial interval therebetween. These methos of allotting the originated hall calls to suitable ones of the elevator cars are thus effective in that the average waiting time can be remarkably shortened compared with the elevator control employed in the past. Further, due to the fact that an elevator car which should respond to a hall call can be allocated as soon as such hall call is originated, the passengers waiting in the hall of the specific floor can be immediately informed of the elevator car instructed to service this floor, so that improved service can be offered to the passengers waiting in the hall, of the hall call originating floor.

However, these and other prior art car allotting methods have been found defective in that an undesirable situation may occur in which hall calls originated after allotment of preceding hall calls to an elevator car may be allotted to the same elevator car which will finally be loaded to its full capacity to leave some passengers without the chance of getting thereon when this elevator car services all the allotted hall calls. In such a case, this elevator car is loaded to its full capacity before servicing all the allotted hall calls and cannot service the additionally allotted hall calls even when it stops at these floors, and the passengers waiting in the hall of these floors must actuate the hall call buttons again to wait for arrival of another elevator car. This is undesirable in that the passengers standing in the hall must wait for a very large length of time. Such undesirable situation may be avoided by a method in which, when the specific elevator car is loaded to its full capacity, the remaining hall calls which cannot be serviced by that elevator car are allotted again to another elevator car. However, in the elevator system in which display lamps are provided in the hall of the floors so that the passengers waiting in the hall can be informed of an elevator car servicing the hall calls, it is necessary to energize another display lamp while deenergizing the previously lit display lamp as a result of this re-allotment. This results in the loss of reliability of dislay by the display lamps.

Further, the prior art allotting methods do not take into consideration the length of time for which the passengers in the hall of the floors must wait until an elevator car can service the floors originating the hall calls. Thus, these hall calls may be allotted to an elevator car which requires a very large length of time until it can service the floors originating the hall calls.

Some examples of moderm elevator control have been briefly described hereinbefore. The undesirable situation pointed out in the above description is considered to be given rise to for the reasons that the number of passengers in each individual elevator car is not detected, and therefore, whether or not the elevator cars are loaded to the full capacity thereof cannot be forecast, and that no consideration is given to the length of time for which the passengers in the hall must wait until a selected one of the elevator cars can service the hall call originating floors.

Computing means has been proposed recently for computing the number of in-cage passengers and the length of time for which the passengers originating hall calls in the hall must wait until a selected one of the elevator cars can service the hall call originating floors. Thus, the hall calls can be allotted to a selected elevator car which has still the room for receiving the passengers originating the hall calls and which can arrive at these floors with a minimum of waiting time. This proposal is satisfactory in that the hall calls originated from the floors can be allotted to an elevator car most suitable for servicing these floors and a remarkable improvement can be made in the elevator car control while obviating the prior art defects pointed out hereinbefore.

However, this improved method of allotting the hall calls has been found still unsatisfactory as it gives rise to an undesirable situation as described below. Such an undesirable situation occurs when the service condition of an elevator car is changed due to allotment of a new hall call in addition to previously allotted hall calls. When such new hall call is additionally allotted, the length of time required for the elevator car to service the previously allotted hall calls may be extended or the elevator car may be loaded to its full capacity by servicing the newly allotted hall call and may become impossible to service some of the previously allotted hall calls. More precisely, suppose, for example, that an elevator car A is located for upward movement at the second floor of a building having 10 floors, and an up hall call originated from the ninth floor has been allotted to the elevator car A. Suppose then that a new up hall call is originated from the sixth floor. It is supposed herein that the number of passengers in the elevator car A at the sixth floor is less than a predetermined limit, and that the waiting time for the passenger or passengers at the sixth floor is also less than a predetermined limit. Therefore, the up hall call originated from the sixth floor may be allotted to the elevator car A. However, the service condition of the elevator car A is changed due to the allotment of this new hall call. This is because the elevator car A must stop at the sixth floor. Due to the necessity for stopping at the sixth floor, the length of time required for the elevator car A to service the already allotted hall call from the ninth floor is extended, and the number of in-cage passengers is increased before the elevator car A can service the ninth floor because a passenger or passengers get on the elevator car A at the sixth floor. Thus, an undesirable situation may occur such that the elevator car A may be loaded to its full capacity before it services the already allotted hall call from the ninth floor or the waiting time for the passenger or passengers at the ninth floor may be considerably extended even when the elevator car A is not loaded to its full capacity.

Such undesirable situation occurs for the reason that, in the prior art and recently proposed methods of allotting hall calls, an elevator car most suitable for servicing a newly originated hall call is selected and this hall call is allotted to the selected elevator car. In other words, no consideration is given to the change in the service condition of the elevator car due to allotment of the new hall call in addition to the already allotted hall calls.

It is therefore an object of the present invention to provide an improved elevator control system which ensures efficient operation of all the elevator cars for all the hall calls thereby improving the serviceability of the elevator cars.

Another object of the present invention is to provide an elevator control system which can shorten and substantially uniformalize the average length of time for which the passengers originating the hall calls must wait.

Still another object of the present invention is to provide an elevator control system in which the elevator cars capable of receiving all the passengers originating hall calls and waiting in the hall can always be selected to service these hall calls so that satisfactory service can be offered to these passengers without giving rise to the possibility of full loading or leaving some of the passengers at the floors, and thus, the reliability of the elevator service can be improved.

In accordance with one aspect of the present invention, there is provided an elevator control system for controlling a plurality of elevator cars arranged for parallel operation for servicing a plurality of service floor landings of a building, comprising hall call registering means disposed at the landing of each floor, cage call registering means disposed in each said car for instructing target floors, means for selecting suitable ones of said cars for servicing hall calls, and means for allotting the hall calls to said selected cars, said servicing car selecting means comprising means for computing to forecast the change in the service condition of each said car for the hall calls allotted thereto already when a new hall call originated from one of the floors is provisionally allotted thereto.

In accordance with another aspect of the present invention, there is provided an elevator control system of the above character, wherein there are further provided means for computing for each said car the forecast waiting time at each of the already allotted floors until arrival of said car at these floors in response to the application of signals including at least a signal representative of the car position and signals representative of the already allotted hall calls, and means for setting the limit of waiting time at the hall call originating floors to be serviced by said selected cars, and said servicing car selecting means comprises means for computing for each said car the forecast waiting time at each of the already allotted floors until arrival of said car at these floors when the new hall call is provisionally allotted thereto, and means for comparing for each said car the forecast waiting time at each said floor with the waiting time limit so as to determine the serviceability of said cars for said new hall call.

In accordance with still another aspect of the present invention, there is provided an elevator control system of the above character, wherein there are further provided means for computing to forecast the number of passengers in each said car at each of the successive floors in the moving direction thereof in response to the application of signals including at least a signal representative of the number of passengers initially present therein and signals each representative of the number of passengers waiting at the already allotted floors, and means for setting the loading limit of the cars, and said servicing car selcting means comprises means for computing to forecast for each said car the change in the number of passengers therein at each of the already allotted floors when the new hall call is provisionally allotted thereto, and means for comparing the number of predictive passengers at each said floor with the loading limit so as to determine the serviceability of said cars for said new hall call.

The above and other objects, features and advantages of the present invention will become apparent from the following detailed description taken in conjunction with the accompanying drawings, in which:

FIGS. 9 to 12 show circuits for provisionally allotting a new hall call to all the elevator cars, computing the serviceability of the elevator cars, and allotting the hall call to one of the selected elevator cars, wherein:

FIG. 9 shows a ring counter circuit;

FIG. 10 shows a circuit for generating a provisional allotment instruction signal in response to an up hall call originated from the second floor, such circuit being provided for each of the floors and each of the moving directions;

FIG. 11 shows a circuit for generating a car allotting signal in response to the application of the input from the circuit of FIG. 10, such circuit being provided for each of the floors and each of the moving directions; and FIG. 12 shows a circuit for allotting the up hall call from the second floor, such circuit being provided for each of the floors and each of the moving directions;

The basic principle of the first embodiment of the present invention will be described with reference to FIG. 1 before describing the structure and operation thereof in detail.

Figure 1:
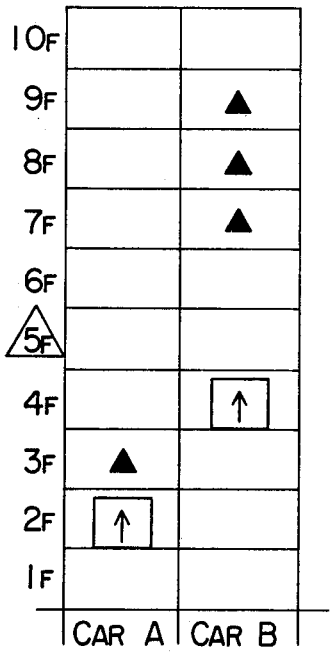
FIG. 1 is a diagrammatic view for illustrating the basic principle of the present invention.

Referring to FIG. 1, two elevator cars A and B are arranged for parallel operation for servicing the first to 10th floors of a building having 10 floors. In FIG. 1, the car A is shown located at the second floor for upward movement and the car B is shown located at the fourth floor for upward movement. An up hall call (represented by the black triangle) is originated from the third floor and is allotted already to the car A, while up hall calls (represented by the black triangles) are originated from the seventh, eithth and ninth floors and are allotted already to the car B. Suppose that a new up hall call (represented by the white triangle) is originated from the fifth floor in the state shown in FIG. 1. According to the prior art methods, this new up hall call is allotted to the car B, because, in this case, the car B is located nearer to the fifth floor than the car A and can thus service the fifth floor earlier than the car A. It should be noted however that the up hall calls from the seventh, eighth and ninth floors, which are remote in the moving direction of the car B from the fifth floor originating this new hall call, are allotted already to the car B. Therefore, when the hall call from the fifth floor is allotted to the car B, the waiting times for the passengers registering the hall calls at the seventh, eighth, and ninth floors and waiting the arrival of the car B are extended respectively by a lenght of time required for the car B to stop at the fifth floor.

Suppose, for simplicity of explanation, that the length of time required for each car to run one floor interval is 2 seconds, and the length of time required for stopping at one of the floors is 10 seconds. Then, in the case of the car A located at the second floor for upward movement, the number of floor intervals which must be run by the car A to arrive at the fifth floor is three, and the number of stops required for the car A is one since the up hall call from the third floor intermediate between the second and fifth floors is only allotted thereto. Therefore, the total length of time required for the car A to arrive at the fifth floor is estimated to be $2 \times 3 + 10 \times 1 = 16$ seconds. In the case of the car B located at the fourth floor for upward movement, the number of floor intervals which must be run by the car B to arrive at the fifth floor is one, and the number of stops required for the car B is zero, since there is no intermediate floor between the fourth and fifth floors and neither cage calls nor hall calls are allotted thereto except the hall calls above specified. Therefore, the total length of time required for the car B to arrive at the fifth floor is estimated to be $2 \times 1 + 10 \times 0 = 2$ seconds which is less than that for the car A. However, the up hall calls from the seventh, eighth and ninth floors, which are remote from the fifth floor in the moving direction of the car B, have already been allotted to the car B. Therefore, when the up hall call from the fifth floor is allotted to the car B, this car B is required to make one additional stop before it can service the seventh, eighth and ninth floors. Thus, the lengths of time for which the passengers must wait at the seventh, eighth and ninth floors are extended by 10 seconds, and the previous values of 6 seconds, 18 seconds and 30 seconds are increased to 16 seconds, 28 seconds and 40 seconds respectively. On the other hand, any up hall calls from the floors remote from the fifth floor in the moving direction of the car A are not allotted to the car A, and thus, the up hall call from the third floor is not affected in any way by the up hall call from the fifth floor even when this latter hall call is allotted to the car A. For the purpose of improving the service for the whole hall calls, therefore, it is preferable to allot the up hall call from the fifth floor to the car A.

However, according to the prior manner of elevator control as described previously, a car which can service a new hall call earlier than others is selected and the new hall call is allotted to that car. In the case FIG. 1, the up hall call from the fifth floor is allotted to the car B according to the prior manner of elevator control.

In a method recently proposed, an allowable maximum length of time at each of the individual floors is selected as a waiting time limit, and no hall calls are allotted to a car which provides a waiting time greater than the above limit. According to this method, however, a new hall call is allotted to any suitable car when this car can service the new hall call within the waiting time limit. Suppose, for example, that the waiting time limit is selected to be 30 seconds. Referring to FIG. 1, the passenger or passengers originating the up hall call at the fifth floor wait for a length of time of 16 seconds in the case of the car A and 2 seconds in the case of the car B, and both these values are within the waiting time limit of 30 seconds. Thus, the up hall call from the fifth floor is allotted to the car B as in the prior art manner since the car B can service this hall call earlier than the car A.

Such an undesirable situation occurs for the reason that none of the prior art methods have not been adapted to forecast the change in the service condition of these cars due to allotment of a new hall call thereto.

In the elevator control system according to the present invention, the change in the service condition of each of a plurality of elevator cars as a result of allotment of a new hall call is forecast, and the result of this forecast is utilized to select the car which is suitable to service the new hall call.

Referring to FIG. 1 again, both the car A and the car B can service the up hall call from the fifth floor. According to the present invention, the change in the service condition of each of these cars A and B as a result of allotment of this up hall call is forecast, and the changes in the service condition of the cars A and B are compared with each other for deciding the car which should service the up hall call from the fifth floor. Suppose that the waiting time limit is set to be 30 seconds as described. In the case of the car B, it can service the already allotted hall calls from the seventh, eight and nineth floors with 6 seconds, 18 seconds and 30 seconds respectively all of which do not exceed the waiting time limit, when this car B does not service the hall call from the fifth floor. However, when this car B services the hall call from the fifth floor, the above values are increased to 16 seconds, 28 seconds and 40 seconds respectively, and the length of time required to arrive at the nineth floor exceeds the waiting time limit resulting in delayed service. In the present invention, the change in the service condition of each of the cars A and B as a result of servicing the hall call from the fifth floor is forecast to decide the car which should service the hall call from the fifth floor. The car B is not selected since the length of time required for the car B to arrive at the nineth floor exceeds the waiting time limit. On the other hand, in the case of the car A, no change occurs in the service condition thereof even when the hall call from the fifth floor is allotted thereto, since the only hall call allotted thereto already is the up hall call from the third floor. Further, the car A can service the hall call from the fifth floor with 16 seconds which does not exceed the waiting time limit. Thus, the car A is selected to service the hall call from the fifth floor.

The above description has referred to the case of forecasting the waiting time to seek the change in the service condition of each car after the allotment of a new hall call. However, it is also effective to forecast the number of in-cage passengers to seek the change in the service condition of each car. In this case, it is necessary to provide a detector at each floor for detecting the number of waiting passengers in the hall of each floor.

Suppose, for example, that the passenger loading limit of the cars A and B is 10, four passengers and two passengers are present in the cars A and B respectively, and two passengers, two passengers, four passengers and two passengers are waiting in the hall of the third floor, seventh floor, eighth floor and nineth floor respectively. In this case, the number of passengers in the car A is forecast to be six at the third floor, while the number of passengers in the car B is forecast to be four, eight and 10 at the seventh, eight and nineth floors respectively. Therefore, the cars A and B can service these floors without being loaded to the full capacity thereof. Suppose then that a new hall call is originated from the fifth floor and three passengers are waiting in the hall of the fifth floor.

In such a case too, the change in the service condition of each of the cars A and B as a result of servicing the hall call from the fifth floor is forecast in the present invention. When the car B is selected to service the hall call from the fifth floor, the number of passengers in the car B is forecast to be five at the fifth floor, eleven at the eight floor and thirteen at the nineth floor. The result of this forecast teaches that one passenger cannot get on the car B at the eighth floor and the car B loaded to its full capacity cannot service the nineth floor. Thus, the hall call from the fifth floor is not allotted to the car B. On the other hand, the number of passengers in the car A is forecast to be six at the third floor and nine at the fifth floor, and the car A can satisfactorily service the hall call from the fifth floor. Thus, the car A is selected to service the fifth floor, and the hall call from the fifth floor is allotted to the car A.

In the above description referring to the forecast of the number of passengers in the cars, the number of passengers getting off the cars is not forecast for the brevity of explanation. The number of passengers getting off the cars is merely detected on the basis of the fact that the number of passengers in the cars is reduced as some of them get off the cars. This manner of forecasting may be effective to some extent for the purpose of the present invention. An embodiment of the present invention described hereinunder is provided with means for forecasting the number of passengers getting off the cars for the purpose of forecasting the number of passengers actually present in the cars.

Further, the above description has referred to the case in which the service condition subject to a change due to allotment of a new hall call is compared with a predetermined setting so as to determine the serviceability of the cars and select the car suitable for the service. However, the service condition subject to a change due to allotment of a new hall call may be detected by another method so as to select the car suitable for the service. This method will be described in another embodiment of the present invention described later.

Figure 2:
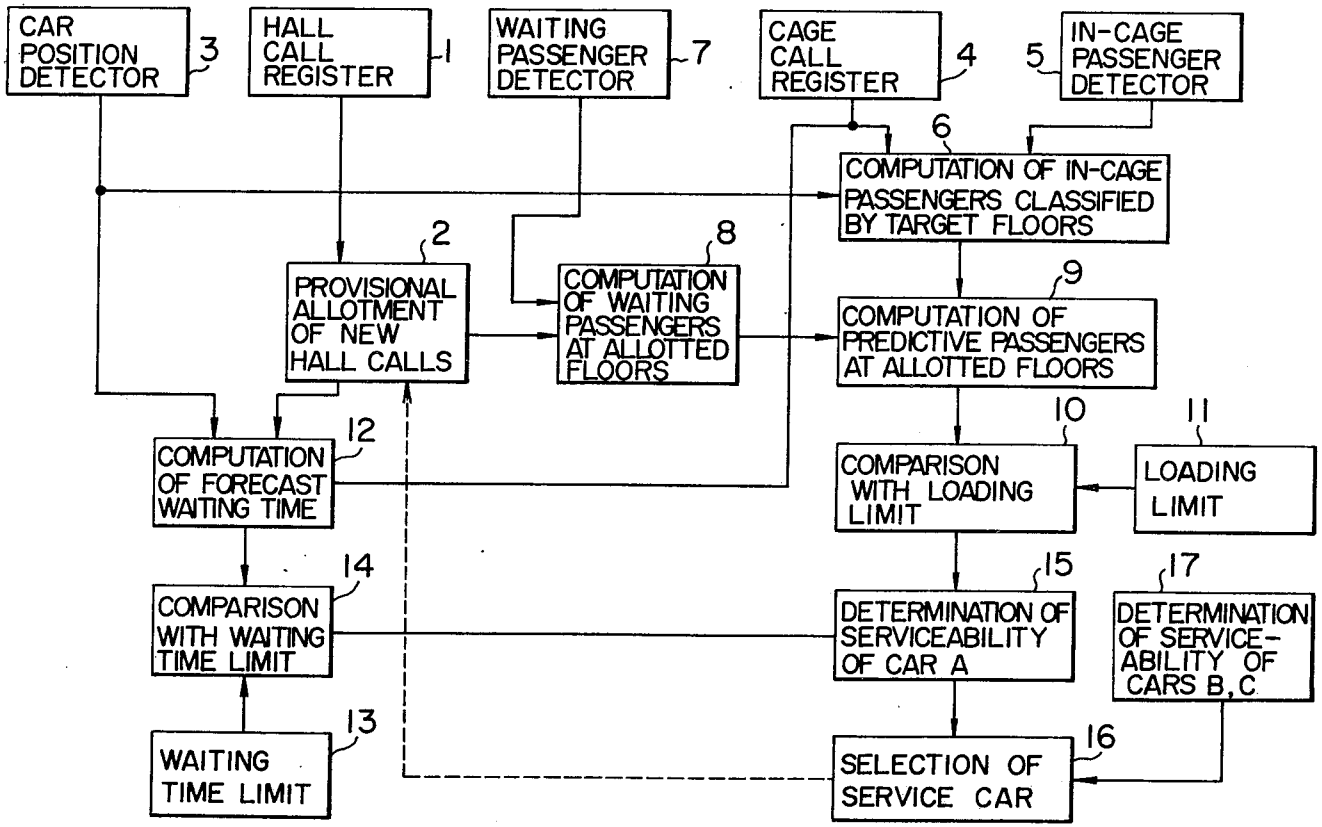
FIG. 2 is a block diagram showing the general structure of an embodiment of the present invention the details of which are shown in FIGS. 3 to 13.

An embodiment of the elevator control system of the present invention is shown in block diagram in FIG. 2. The general structure of the elevator control system embodying one form of the present invention will now be described with reference to FIG. 2.

In the following description, it is supposed that three elevators cars A, B and C are arranged for parallel operation to service the first to 10th floors of a building having 10 floors. In the first embodiment which will be described with reference to FIGS. 2 to 13, means are provided for detecting the number of in-cage passengers classified by their target floors and detecting the forecast waiting time at each of the individual floors serviced by the cars A to C.

Referring to FIG. 2 showing means associated with, for example, the car A except means 11 and 13 common to all the cars and means 17 provided for the cars B and C, a hall call registering means 1 is disposed at the landing of each floor, and these means 1 are connected to a means 2 which allots hall calls provisionally to all the cars so that the serviceability of the cars can be computed and the hall calls can be allotted to the cars which can service the hall calls. A car position detecting means 3, a cage call registering means 4 and a means 5 for detecting the number of passengers in the car A are connected to a means 6 which computes the number of passengers in the car A classified by their target floors. A means 7 for detecting the number of passengers waiting in the hall is provided at each floor. These detecting means 7 and the means 2 are connected to a means 8 which computes the number of passengers waiting at each of the floors the hall calls from which are allotted to the car A. The means 6 and 8 are connected to a means 9 which computes the number of predictive passengers in the car A at each of the successive allotted floors on the basis of the inputs from the means 6 and 8. The output of the means 9 representative of the number of predictive passengers in the car A at each of the successive allotted floors is applied to a means 10 which compares such input with an input representative of a loading limit applied from a loading limit setting means 11 to determine whether or not the passengers at each of the successive allotted floors can get on the car A. The means 2, 3 and 4 are connected to a means 12 which computes the forecast waiting time at each of the successive allotted floors until serviced by the car A on the basis of the number of floors at which the car A is instructed to stop by the cage calls or hall calls allotted thereto already, the physical position of the car A, and the distance between the present location of the car A and each of the successive allotted floors. The output of the forecast waiting time computing means 12 is applied to a means 14 which compares such input with an input representative of a waiting time limit applied from a waiting time limit setting means 13 to determine as to whether or not the forecast waiting time at each of the successive allotted floors exceeds the waiting time limit. The outputs of the means 10 and 14 are applied to a means 15 which determines the serviceability of the car A for the successive allotted floors. The output of the serviceability determining means 15 is applied, together with the outputs of similar means 17 provided for the other cars B and C, to a servicing car selecting means 16 which selects the cars which can service the hall calls without exceeding the loading limit and waiting time limit.

In response to the origination of a new hall call, the means 2 operates in such a manner as to provisionally allot this new hall call to all the cars so that necessary computation can be carried out in the system. In other words, the number of predictive passengers in each car and the forecast waiting time until arrival of each car at each of the hall call originating floors are computed supposing that this new hall call is allotted to each car. Then, determination is made as to whether or not the forecast waiting time is less than the waiting time limit and whether or not the number of predictive in-cage passengers is less than the loading limit when each car services the new hall call in addition to the hall calls allotted already thereto. The serviceability determining means 16 provided for the car A determines the serviceability of the car A for the new hall call. In response to the application of the serviceability signal from the serviceability determining means 15 and the similar signals from the similar means 17 provided for the other cars B and C, the servicing car selecting means 16 selects the car which can service the new hall call earlier than the others. Thus, the new hall call is allotted to the selected car which is most suitable for the required service.

It will thus be seen that a new hall call can be allotted to one of the cars while taking into consideration the change in the service condition of each of the cars as a result of allotment of such new hall call, and the elevator control most suitable for servicing the hall calls can be attained.

The practical structure of the embodiment shown in FIG. 2 will be described in detail with reference to FIGS. 3 to 13.

Figure 3:
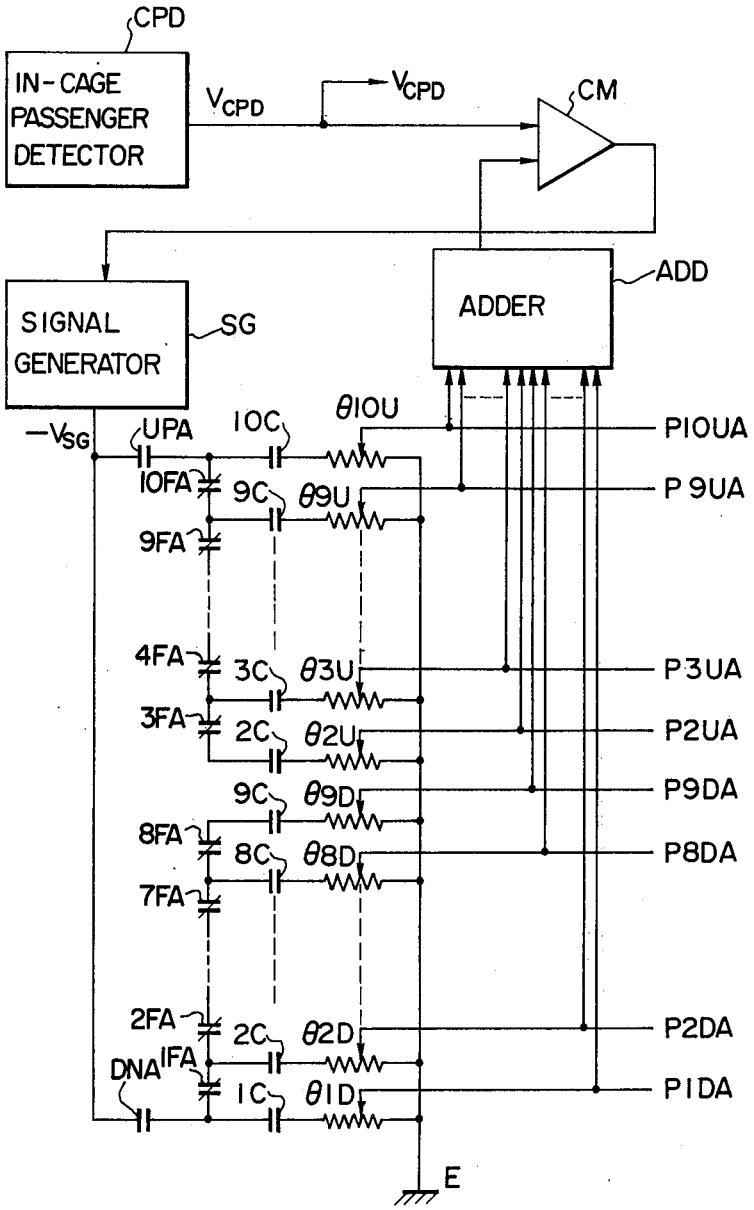
FIG. 3 shows a circuit for computing the number of passengers in the elevator car A classified by their target floors, such circuit being also provided for each of the other elevator cars B and C.

FIG. 3 shows a circuit for classifying the passengers in each car according to their target floors by computation. The circuit shown in FIG. 3 is provided for the car A, and it is apparent that similar circuits are also provided for the cars B and C. An in-cage passenger detector CPD such as a weighing means is disposed beneath the floor of the car A to produce an output signal $V_{CPD}$ which is proportional to the number of in-cage passengers. A comparator CM compares the output signal $V_{CPD}$ of the in-cage passenger detector CPD with an output signal of an adder ADD to provide a positive output signal and a negative output signal when the output of the detector CPD is higher and lower than the output of the adder ADD respectively. A signal generator SG generates a negative output $-V_{SG}$ whose value is dependent on the output of the comparator CM. That is, the absolute value of the output voltage $-V_{SG}$ of the signal generator SG is increased when the output of the comparator CM is positive, and this absolute value is decreased when the output of the comparator CM is negative, while this absolute value remains unchanged when the output of the comparator CM is zero. Relay contacts UPA and DNA are turned on when the car A moves upward and downward respectively. Relay contacts 1FA to 10FA of a position detecting relay are turned off when the car A is located at the first to 10th floors respectively. Relay contacts 1C to 10C are turned on when cage calls for the first to 10th floors are registered in the car A respectively. Variable resistors θ2U to θ10U and θ1D to θ9D are suitably set to generate predetermined negative output voltages P2UA to P10UA and P1DA to P9DA corresponding to the level of the input voltage $-V_{SG}$.

Suppose, for example, that the car A is located at the fourth floor for upward movement with a plurality of passengers therein, the cage calls for the nineth and 10th floors are registered by the passengers therein. The output signal $V_{CPD}$ of the in-cage passenger detector CPD, which is proportional to the number of incage passengers, is compared with the output of the added ADD by the comparator CM, and the output of the comparator CM is applied to the signal generator SG. The output $-V_{SG}$ of the signal generator SG is applied to the variable resistor θ9U by the route of SG-UPA-10FA-9C-θ9U and to the variable resistor θ10U by the route of SG-UPA-10C-θ10U. These variable resistors θ9U and θ10U are set to provide predetermined settings E9U and E10U respectively. Therefore, the outputs of these variable resistors θ9U and θ10U, hence the signals P9UA and P10UA representative of the number of in-cage passengers classified by the target floors or the nineth and 10th floors are given by $-V_{SG}$·E9U and $-V_{SG}$·E10U respectively. These signals P9UA and P10UA are applied to the adder ADD to be added together, and the output of the adder ADD is compared by the comparator CM with the output $V_{CPD}$ of the in-cage passenger detector CPD. The absolute value of the output voltage $-V_{SG}$ of the signal generator SG is increased when $-V_{CPD}$ - ($V_{SG}$·E9U + $V_{SG}$·E10U) is positive. Thus, the comparator CM acts to control the signal generator SG to give the relation $V_{CPD} - (v_{SG} \cdot E9U + V_{SG} \cdot E10U) = 0$. Therefore, the voltage $V_{CPD}$ representative of the number of in-cage passengers is equal to the sum of the voltages P9UA and P10UA representative of the number of in-cage passengers classified by the target floors or the ninth and 10th floors when the output signal level of the signal generator SG is selected to be equal to the output signal level of the in-cage passenger detector CPD.

In this manner, the output voltages P2UA to P10UA and P1DA to P9DA representative of the number of in-cage passengers classified by their target floors can be obtained. The variable resistors θ2U to θ10U and θ1D to θ9D are suitably set to classify the in-cage passengers according to their target floors. In view of the known tendency of the passengers utilizing the elevator cars, the variable resistors associated with the floors at which many passengers get off the cars may be selected to have a large setting, while those associated with the floors at which less passengers get off the cars may be selected to have a small setting. For example, the former floors include the lobby floor and restaurant floor.

The circuit for computing the number of incage passengers classified by their target floors is not the subject matter of the present invention, and therefore, the basic structure thereof is only illustrated. Actually, however, the circuit structure becomes more complex for the purpose of improving the precision of operation.

Figure 4:
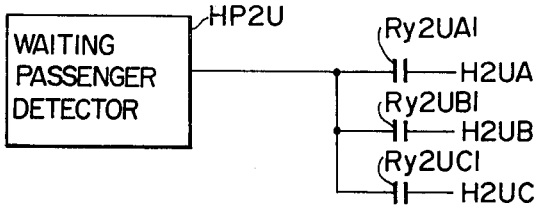
FIG. 4 shows a circuit for computing the number of passengers waiting in the hall of the second floor by originating an up hall call, such circuit being provided for each of the floors and each of the car moving directions.

FIG. 4 shows one form of a circuit disposed in the hall of, for example, the second floor for computing the number of passengers waiting at the second floor by registering an up hall call. Referring to FIG. 4, a detector HP2U for detecting the number of waiting passengers applied its output signal H2UA, H2UB or H2UC to a circuit of FIG. 5 through the corresponding one of contacts Ry2UA1, Ry2UB1 and Ry2UC1 of relays Ry2UA, Ry2UB and Ry2UC which are provided for the cars A, B and C respectively and turned on in response to the allotment of a hall call in a manner as described later with reference to FIG. 12.

This hall waiting passenger detector HP2U may be anyone of various forms as described below.

1. A plurality of mat switches each having a size corresponding to the unit floor area (of, for example, 60 × 40 cm) occupied by one passenger are disposed at the landing of each floor so as to detect the number of waiting passengers on the basis of the number of such mat switches which are energized.

2. A plurality of ultrasonic wave transmitters and receivers are mounted on the ceiling of side walls of the hall adjacent to the landing of each floor so as to detect the number of persons present in the hall thereby detecting the number of waiting passengers on the basis of the amount of reflected waves.

3. An industrial television camera is disposed in the hall adjacent to the landing of each floor so as to detect the number of waiting passengers on the basis of the state of the output or variations in the picture elements of the camera.

Figure 5:
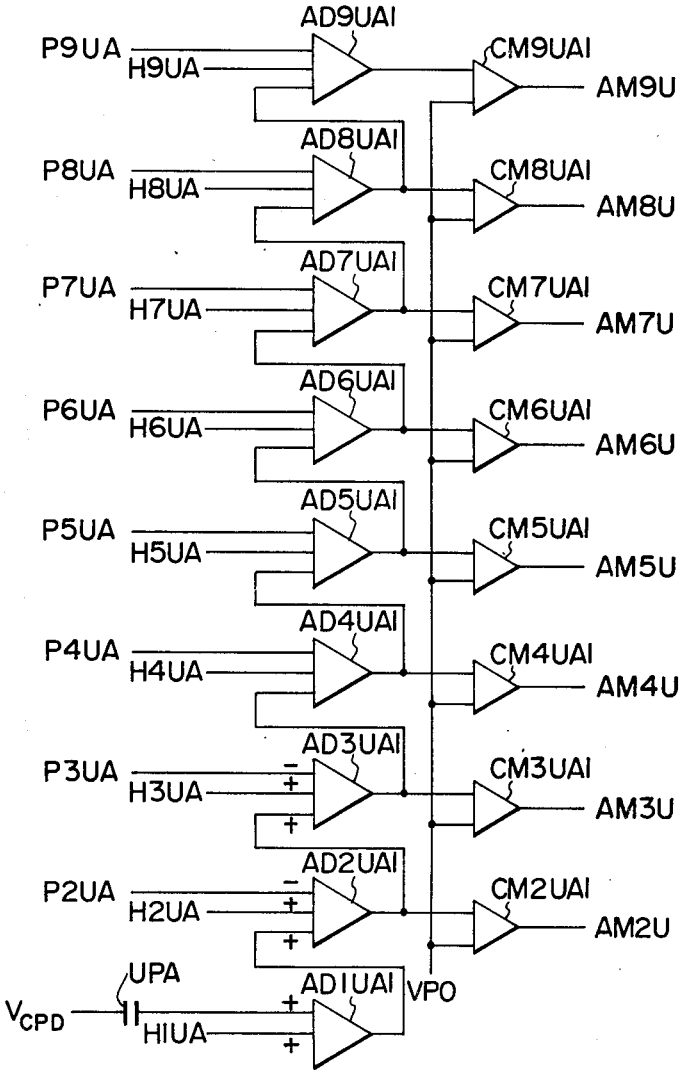
FIG. 5 shows a circuit for determining the number of prospective passengers in the elevator car A at each of the successive floors when the elevator car A moves upward, such circuit being provided for each of the elevator cars and each of the moving directions.

FIG. 5 shows a circuit for forecasting the number of predictive passengers at each of the successive floors so as to determine whether or not the car A instructed to move upward can service these floors. It is apparent that a circuit similar to that shown in FIG. 5 is also provided for the car A to operate during the downward movement thereof, and similar circuits are also provided for the cars B and C. Referring to FIG. 5, the signal $V_{CPD}$ representative of the number of passengers in the car A, the signals P2UA to P9UA representative of the number of passengers in the car A classified by their target floors, and the signals H2UA to H9UA representative of the number of passengers waiting in the hall of the floors are applied from the circuits shown in FIGS. 3 and 4. The circuit shown in FIG. 5 includes adders AD1UA1 to AD9UA1 and comparators CM2UA1 to CM9UA1. These comparators deliver an output of 1 level when the sum of the inputs thereto is greater than zero. A reference voltage VPO is applied to all the comparators CM2U1 to CM9UA1 and is set at a negative level corresponding to the loading limit for the car A. The comparators CM2UA1 to CM9UA1 deliver respective signals AM2U to AM9U representative of the result of comparison to determine the number of predictive passengers. These signals AM2U to AM9U are in a 0 level when the passengers waiting at the associated floors can get on the car A.

The signal $V_{CPD}$ is applied to the adder AD1UA1 through a relay contact UPA which is turned or when the car A moves upward. The signal H1UA representative of the number of passengers waiting in the hall of the first floor by originating an up hall call is also applied to the adder AD1UA1 which therefore delivers an output representative of the number of predictive passengers at the first floor. The output of the adder AD1UA1 is applied to the adder AD2UA1 together with the signal P2UA representative of the number of passengers whose target floor is the second floor and the signal H2UA representative of the number of passengers waiting in the hall of the second floor. The signal P2UA is a negative voltage signal as described with reference to FIG. 3 and is thus applied to the adder AD2UA1 to be subtracted thereby. Therefore, the output of the adder D2UA1 is representative of the number of predictive in-cage passengers at the second floor in which the passengers getting on and off the car A at the second floor is taken into account. The output of the adder AD2UA1 is then applied to the adder AD3UA1. Thus, the outputs of the succeeding adders AD3UA1 to AD9UA1 are representative of the number of predictive in-cage passengers at the third to nineth floors respectively.

The comparators CM2UA1 to CM9UA1 connected to the respective adders AD1UA1 to AD9UA1 compare the outputs of the respective adders with the signal VPO representative of the loading limit so as to determine as to whether the number of predictive in-cage passengers at each floor exceeds the loading limit or not. When some of the outputs of the adders exceeds the loading limit represented by the signal VPO, the corresponding ones of the signals AM2U to AM9U take a 1 level to indicate that no passengers can get on the car A at the corresponding floors.

Figure 6:
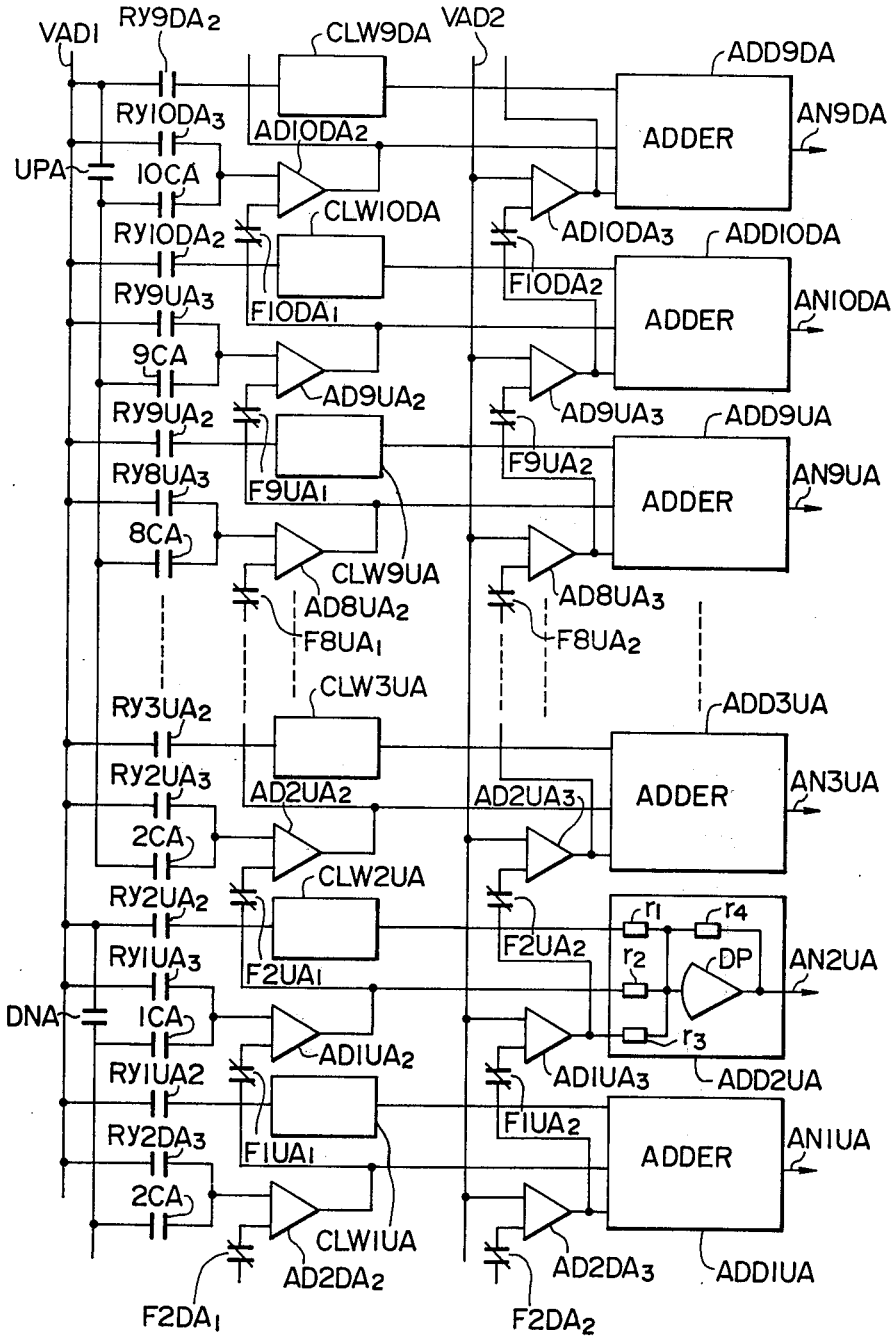
FIG. 6 shows a circuit for computing the forecast waiting time at each of the successive floors when the elevator car A moves upward, such circuit being provided for each of the elevator cars and each of the moving directions.

FIG. 6 shows a circuit for computing the forecast waiting time at each of the successive floors when the car A moves upward. It is apparent that a circuit similar to that shown in FIG. 6 is also provided for the car A to operate durin the downward movement thereof, and similar circuits are also provided for the cars B and C.

Figure 12:
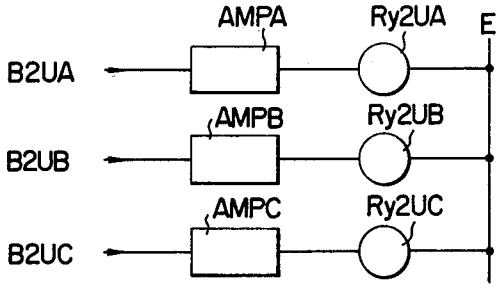

Referring to FIG. 6, a predetermined voltage VAD1 which corresponds to a length of time required for the car A to stop at one of the floors is applied to the circuit. Another predetermined voltage VAD2 corresponding to a length of time required for the car A to run one floor interval is also applied to the circuit. The circuit includes relay contacts Ry1UA2 to Ry10DA2 and Ry1UA3 to Ry1ODA3 of relays Ry1UA to Ry1ODA which are turned on when the car A responds to hall calls originated from the 1st to 10th floors or when a new hall call is provisionally allotted to the car A in a manner as shown in FIG. 12. Relay contacts 1CA to 1OCA are turned on when cage calls for the first to 10th floors are registered in the car A. The circuit further includes adders AD1UA2 to AD10DA2 and AD1UA3 to AD1ODA3, and counters CLW1UA to CLW1ODA. Relay contacts F1UA1 to F1ODA1 and F1UA2 to F1ODA2 are turned off when the car A makes upward movement and downward movement respectively between the first and 10th floors. Adders ADD1UA to ADD1ODA deliver respective signals AN1UA to AN1ODA representative of the forecast waiting time at the first to 10th floors.

Suppose, for example, that the car A is located at the first floor for upward movement, and thus, the relay contacts F1UA1 and F1UA2 are in the off position. In this case, the voltage VAD2 passes through the route of AD1UA3 - F2UA2 - AD2UA3 . . . AD8UA3 . . . , and at the same time, is applied to the adders AD2UA3 to AD1ODA3 as the other input thereto. Thus, the output of the adder AD1UA3 has a voltage level equal to VAD2 corresponding to the length of time required for the car A to run one floor interval. In response to the application of the output voltage of the adder AD1UA3 and the predetermined voltage VAD2 to the adder AD2UA3, the adder AD2UA3 delivers an output voltage signal having a level equal to VAD2 × 2 which corresponds to the length of time required for the car A to run two floor intervals. Similarly, the adders AD-3UA3 to AD1ODA3 deliver output voltage signals having levels corresponding to the length of time required for the car A to run three to 10 floor intervals respectively. In this manner, the voltage signals corresponding to the length of time required for the car A to arrive at the successive floors from the present location thereof are obtained to be applied to the respective adders ADD2UA to ADD9DA.

Suppose then that a cage call for the eighth floor is registered in the car A and a up hall call originated from the second floor is allotted to the car A. In this case, the relay contacts 8CA, Ry2UA2 and Ry2UA3 are turned on. The predetermined voltage VAD1 passes through the route of Ry2UA3-AD2UA2-F3UA1-AD3AU2 . . . F8UA1 to be finally applied to the adder AD8UA2. The output of the adder AD2UA2 has a voltage level equal to VAD1 and a signal corresponding to the length of time required for the car A to stop at one of the floors, and the outputs of the adders AD3UA2 to AD7UA2 are also similar voltage signals. Due to the fact that the relay contact 8CA is turned on, the output signal of the adder AD7UA2 is applied to the adder AD8UA2 together with the voltage VAD1 which is applied through the contact 8CA. Thus, the adder AD8UA2 delivers a voltage signal having a level equal to VAD1 × 2 and corresponding to the length of time required for the car A to stop at two of the floors, and this voltage signal is transmitted successively by the route of AD8UA2-F9UA1-AD9UA2 . . . . Therefore, the outputs of the adders AD2UA2 to AD7UA2 are the voltage signal having a level equal to VAD1 and corresponding to the length of time required for the car A to stop at one of the floors, and the outputs of the adder AD8UA2 and succeeding adders are the voltage signal having a level equal to VAD1 × 2 and corresponding to the length of time required for the car A to stop at two of the floors. These outputs are applied to the adders ADD1UA to ADD1ODA respectively.

In response to the application of these adder outputs to the adders ADD1UA to ADD1ODA, the adders ADD1UA to ADD1ODA deliver output signals AN1UA to AN1ODA representative of the waiting time anticipated for the car A to arrive at the first to 10th floors respectively. Suppose, for example, that the length of time required for the car A to stop for servicing a call is 10 seconds, the length of time required for the car A to run one floor interval is 2 seconds, and the predetermined voltages VAD1 and VAD2 are set at the corresponding levels, Then, the signal AN2UA representative of the forecast waiting time at the second floor has a voltage level corresponding to 2 seconds, and the signal AN3UA representative of the forecast waiting time at the third floor has a voltage level corresponding to 14 seconds.

The above description refers to the case in which the voltages VAD1 and VAD2 are set at predetermined levels respectively. However, these voltages VAD1 and VAD2 may be set at suitable levels, and the adders AD1UA2 to AD1ODA2 and AD1UA3 to AD1ODA3 may be arranged to provide the voltages representative of the number of stops and the voltages representative of the floor interval respectively. In such a case, the desired weight for the length of time required for stopping and the desired weight for the length of time required for floor interval running can be easily obtained by suitably adjusting the operational resistors $r_2$ to $r_4$ in each of the adders ADD1UA to ADD1ODA although those in the adder ADD2UA are only illustrated in FIG. 6.

The forecast waiting time at each of the ten floors is detected in the manner above described. An up hall call is originated from, for example, the second floor to be alloted to the car A as described previously. In addition to the detection of the forecast waiting time, the length of time elapsed after the origination of the up hall call is counted by the counter CLW2UA by the route of VAD1-Ry2UA2-CLW2UA-ADD2UA, and the signal representative of the value thereof is applied to the adder ADD2UA. Thus, the sum of the time elapsed already after the origination of the hall call and the forecast waiting time after the origination of such hall call is obtained by the adder ADD2UA.

It will thus be seen that the forecast waiting time at each of the floors instructed by hall calls and cage calls is computed by detecting the interval between that floor and the present location of each car and detecting the number of stops required for the car.

Figure 7:
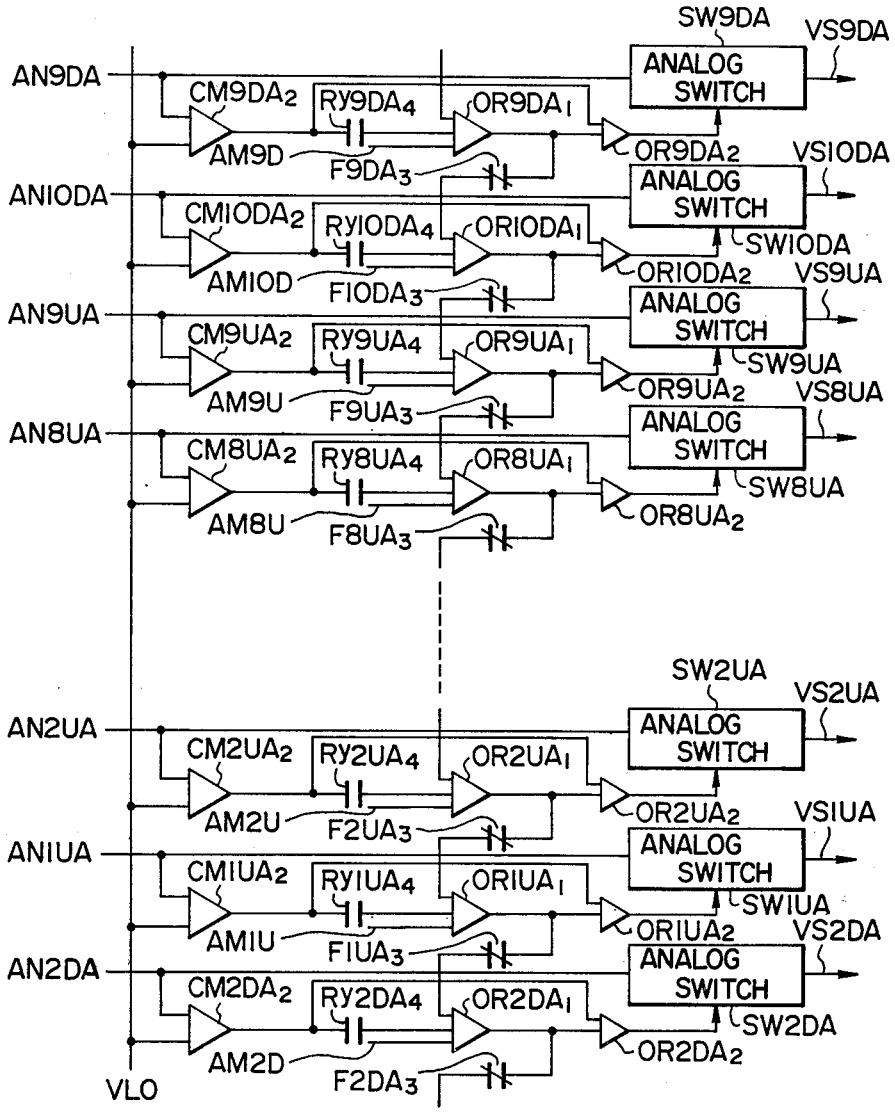
FIG. 7 shows a circuit for determining the serviceability of the elevator car A when it moves upward, such circuit being provided for each of the elevator cars and each of the moving directions.

FIG. 7 shows a circuit for determining the serviceability of the car A when it moved upward. It is apparent that a circuit similar to that shown in FIG. 7 is also provided to operate during the downward movement of the car A, and similar circuits are also provided for the cars B and C.

Referring to FIG. 7, a reference voltage VLO corresponding to a predetermined waiting time is applied to the circuit to be compared with the forecast waiting time signals AN1UA to AN10DA applied from the circuit of FIG. 6. The signals AM2U to AM9U are also applied to the circuit from the circuit of FIG. 5. When the level of the signals AN1UA to AN10DA is lower than the reference voltage VLO and the signals AM1U to AM10D are in the 0 level indicating that the forecast passengers can get on the car A at the first to 10th floors, signals VS1UA to VS10DA appear from the circuit to indicate that the car A can service these floors in response to the hall calls. Referring to FIG. 7, an output of 0 level appears from comparators CM1UA2 to CM10DA2 when the reference voltage VLO is higher than the level of the signals AN1UA to AN10DA. OR gates OR1UA1 to OR10DA1 and OR-1UA2 to OR10DA2 are connected to the respective comparators CM1UA2 to CM10DA2 as shown. Analog switches SW1UA to SW10DA are turned off when an output of 1 level appears from the OR gates OR-1UA2 to OR10DA2.

Suppose, for example, that the car A is instructed to move upward and the level of the signal AN9UA representative of the forecast waiting time at the ninth floor is lower than the reference voltage VLO. Then, an output of 0 level appears from the comparator CM9UA2 to indicate that the forecast waiting time at the ninth floor is less than the predetermined waiting time. The output of the comparator CM9UA2 is applied to the OR gate OR9UA2, thence to the OR gate OR9UA1 through a relay contact Ry9UA4 which is turned on when an up hall call from the ninth floor is allotted to the car A. The signal AM9U is also applied from the circuit of FIG. 5 to the OR gate OR9UA1 together with the output of the OR gate OR10DA1. Suppose now that the signal AM9U is in the 0 level indicating that the passengers can get on the car A at the ninth floor, and the output of the OR gate OR-10DA1 is also in a 0 level. Then, an output of 0 level appears from the OR gates OR9UA1 and OR9UA2 to turn on the analog switch SW9UA. As a result, the signal AN9UA passes through the analog switch SW9UA to appear as a signal VS9UA to indicate that the car A can service the up hall call originated from the ninth floor and the forecast waiting time is the value given by the signal AN9UA.

On the other hand, when the level of the signal AN9UA representative of the forecast waiting time at the ninth floor is higher than the reference voltage VLO, an output of 1 level appears from the comparator CM9UA2 to be applied through the OR gate OR9UA2 to the analog switch SW9UA to turn off this switch, and the signal VS9UA does not appear from the analog switch SW9UA. Further, when the signal AM9U is in the 1 level indicating that the passengers at the ninth floor cannot get on the car A, the analog switch SW9UA is similarly turned off, and the output of the OR gate OR9UA1 is applied through a relay contact F9UA3 of the position relay and through the successive OR gates OR8UA1, OR7UA1, . . . to the OR gate OR1UA1 when the car A is located at the first floor for upward movement. Thus, the analog switches SW9UA, SW8UA, . . . SW1UA are turned off. As a result, none of the signals VS9UA to VS1UA appear to indicate that the car A cannot service up hall calls originated from the floor range between the first floor and the ninth floor. This means that the car A will be loaded to the full capacity thereof when it responds to hall calls originated from the floors beneath the ninth floor after the appearance of the signal AM9U of 1 level.

Suppose further that the car A is decided already to respond to the up hall call from the ninth floor and the relay contact Ry9UA4 is turned on. When, in such a case, the level of the signal AN9UA is higher than the reference voltage VLO, an output of 1 level appears from the OR gates OR9UA1 to OR1UA1 via the circuit of CM9UA2-Ry9UA4-OR9UA1-F9UA3-OR8UA1 . . . F2UA3-OR1UA1. In such a case too, therefore, the analog switches SW9UA to SW1UA are turned off. It will be apparent therefore that, in this case, the car A is prevented from responding to the up hall calls from the floors beneath the ninth floor and passes by these floors so as to avoid an undesirable delay in the service for the up hall call from the ninth floor and to avoid an undesirable extension of the waiting time at the ninth floor.

It will thus be seen that the circuit of FIG. 7 acts to determine the floors at which the forecast waiting time is less than a predetermined setting and the passengers can get on the cars, and generates the signals VS1UA to VS10DA when the conditions are met.

Figure 8:
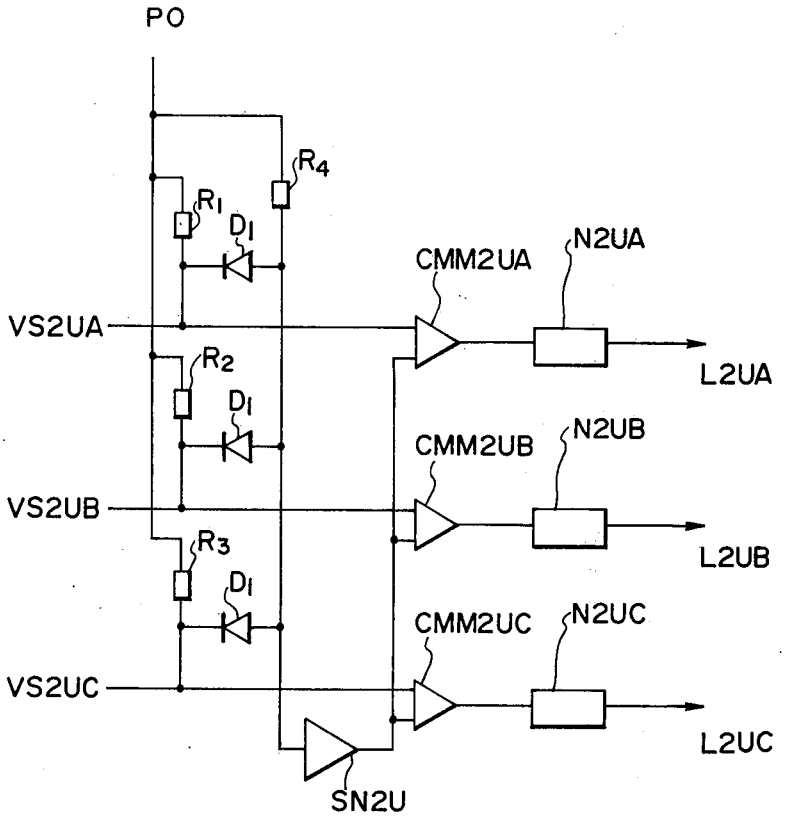
FIG. 8 shows a circuit for the second floor for selecting the elevator car capable of servicing an up hall call from the second floor, such circuit being provided for each of the floors and each of the moving directions.

FIG. 8 shows a circuit for selecting one of the cars which is found most suitable for the service. FIG. 8 illustrates such a selecting circuit provided to respond to an up hall call from the second floor during the upward movement of the cars A to C. It is apparent that a circuit similar to that is provided for each of the other floors and for the other moving direction.

Referring to FIG. 8, the signals VS2UA to VS2UC indicating the serviceability of the cars A to C for an up hall from the second floor are applied to the circuit from the circuit of FIG. 7 which is provided for each of the cars A to C. The circuit shown in FIG. 8 selects one of the cars which can service this up hall with a minimum forecast waiting time, and one of signals L2UA to L2UC appears from the circuit to indicate that the servicing car is selected. The circuit includes resistors $R_1$ to $R_4$ ($R_1$, $R_2$, $R_3 > R_4$), diodes $D_1$ to $D_3$, a sign inverter SN2U, comparators CMM2UA to CMM2UC, and NOT gates N2UA to N2UC. The operation of such a minimum selecting circuit is commonly known and such circuit is not the subject matter of the present invention. Therefore, the operation thereof will be described briefly.

Suppose, for example, that all the cars A to C can service an up hall call from the second floor, and the signals VS2UA to VS2UC indicating the serviceability have respective voltage levels of 1V, 2V and 3V corresponding to the forecast waiting times. Current flows through the route of PO-$R_4$-$D_1$-VS2UA and the diode $D_1$ is solely turned on. (It is assumed herein that the forward voltage drop across each diode is 0.5 V.) Thus, the potential at the anode of the diodes connected in common is 1.5 V, and the output voltage of the sign inverter SN2U is −1.5V. The output voltage −1.5 V of the sign inverter SN2U and the signals VS2UA to VS2UC of respective voltage levels of 1V, 2V and 3V are applied to the respective comparators CMM2UA to CMM2UC. The result of comparison gives −0.5 V, 0.5 V and 1.5 V in the respective comparators CMM2UA to CMM2UC. Therefore, an output of 0 level appears solely from the comparator CMM2UA, while an output of 1 level appears from the remaining comparators CMM2UB and CMM2UC. These outputs are applied to the respective NOT gates N2UA to N2UC, with the result that the signal L2UA indicating the selection and decision of the car A as the servicing car is solely in a 1 level, while the other signals L2UB and L2UC are in a 0 level. In this manner, the car which provides a minimum forecast waiting time can be selected from among the cars which can service the up hall call. In this case, the car A is selected to service the up hall call from the second floor.

When, for example, the analog switch SW2UA in FIG. 7 is turned off to open the circuit, the power supply voltage is applied to the cathode of the diode D1 in FIG. 8. Thus, erroneous operation of the circuit is prevented and one of the remaining cars B and C is selected.

Figure 9:
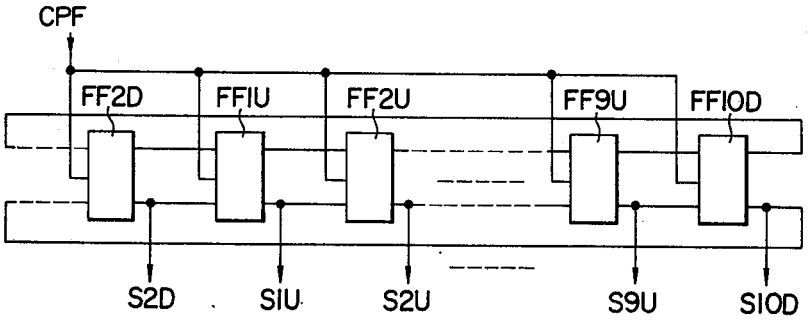

FIG. 9 shows a known ring counter circuit composed of flip-flops FF1U to FF1OD. The circuit operates in synchronism with a clock pulse signal CPF, and actuating signals S1U to S9U and S1OD to S2D of 1 level appear successively in response to up hall calls from the first to ninth floors and down hall calls from the 10th to second floors respectively.

Figure 10:
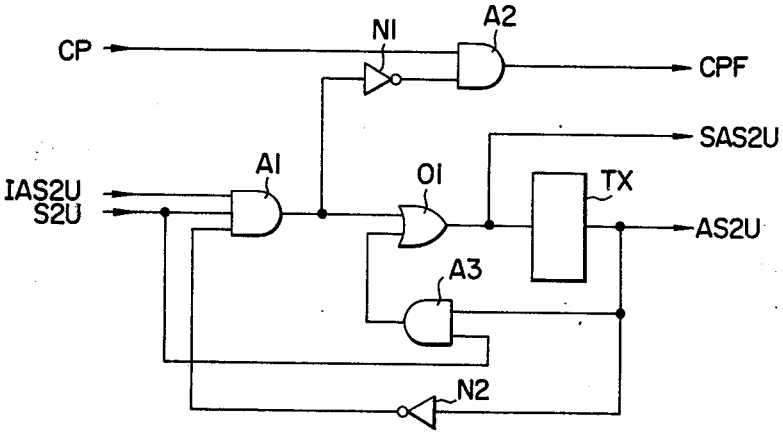
Figure 11:
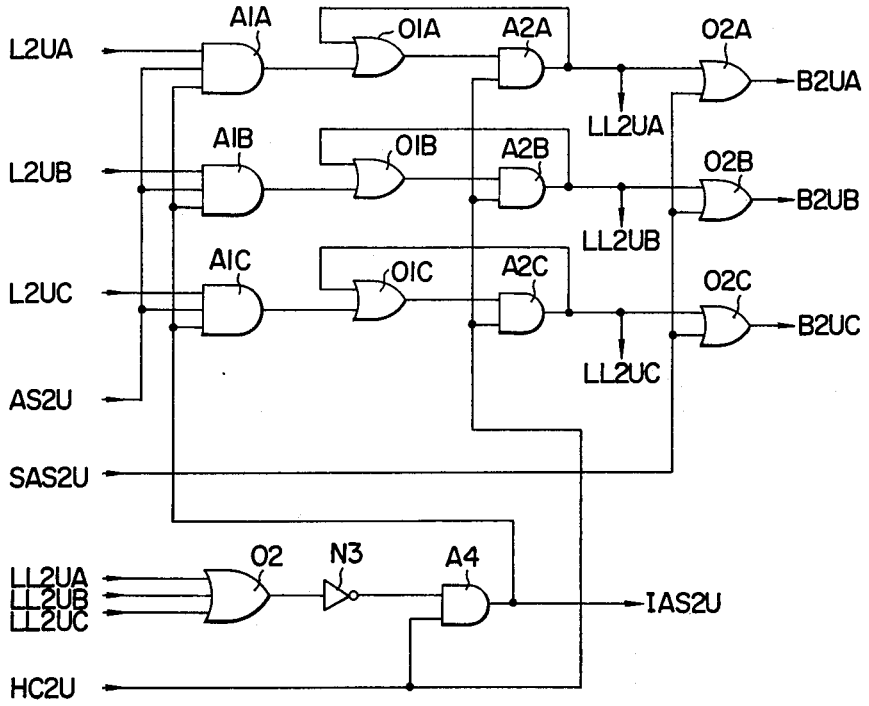

FIGS. 10 to 12 and FIG. 9 show circuits which allot a new hall call provisionally to all the cars, and after necessary computation to forecast the change in the service condition of the cars due to provisional allotment of such a hall call, allot this hall call to the car which is found most suitable for the service. The circuits shown in FIGS. 10 to 12 are provided for responding to an up hall call from the second floor, and it is apparent that such circuit is provided for each of the floors. The circuits shown in FIGS. 10 to 12 include AND gates A1 to A4 and A1A to A2C, OR gates O1, O2 and O1A to O2C, NOT gates N1 to N3, a timer TX, amplifiers AMPA to AMPC, and relays Ry2UA to Ry2UC.

The operation of these circuits will now be described with reference to the case in which an up hall call is originated from the second floor.

In response to the origination of an up hall call from the 2nd floor, a hall call registering signal HC2U of 1 level is supplied to the AND gate A4 in FIG. 11. Further, due to the fact that this up hall call is not allotted yet to anyone of the cars A to C, signals LL2UA, LL2UB and LL2UC indicating allotment of the hall call to the respective cars A to C are all in a 0 level. Therefore, an output of 0 level appears from the OR gate O2, and an output of 1 level appears from the NOT gate N3. An output signal IAS2U of 1 level appears from the AND gate A4 to be applied to the AND gate A1 in FIG. 10. In other words, the signal IAS2U of 1 level appears when a new hall call is originated from the second floor and is not yet allotted to anyone of the cars.

In response to the origination of the up hall call from the second floor, the corresponding actuating signal S2U of 1 level appears from the ring counter circuit shown in FIG. 9. Thus, the three inputs to the AND gate A1 in FIG. 10 are all in a 1 level, and an output of 1 level appears from the AND gate A1. (At this time, the output of the NOT gate N2 is in a 1 level). The output of the AND gate A1 is applied to the NOT gate N1, and an output of 0 level appears from the NOT gate N1 to be applied to the AND gate A2. Therefore, a clock pulse signal CP applied to the AND gate A2 as the other input thereto does not appear at the output of the AND gate A2, and the clock signal output CPF of the AND gate A2 is charged to a 0 level thereby stopping the operation of the ring counter shown in FIG. 9. That is, the actuating signal S2U indicating the origination of the up hall call from the second floor is maintained in the 1 level in the ring counter circuit of FIG. 9.

The output of 1 level of the AND gate A1 is also applied to the OR gate O1 in FIG. 10, and an output signal SAS2U of 1 level appears from the OR gate O1. This signal SAS2U is an instruction signal for provisionally allotting the up hall call from the second floor to all the cars and computing the change in the service condition after the allotment of this hall call. This signal SAS2U is applied to the OR gates O2A, O2B and O2C in FIG. 11 which are associated with the cars A, B and C respectively. Output signals B2UA, B2UB and B2UC of 1 level appear from the OR gates O2A, O2B and O2C to be applied to the amplifiers AMPA, AMPB and AMPC in FIG. 12 thereby energizing the relays Ry2UA, Ry2UB and Ry2UC for allotting the up hall call from the second floor to the cars A, B and C respectively. In this manner, the up hall call originated from the second floor is provisionally allotted to all the cars A to C, so that predictive computation of the change in the service condition after the allotment of this hall call can be carried out.

The forecast waiting time or the number of predictive passengers at each of the floors is then computed when the relay contacts Ry2UA1 to Ry2UA4, Ry2UB1 to Ry2UB4, and Ry3UC1 to Ry2UC4 in FIGS. 3 to 8 are supposed to be energized to allot the up hall call from the second floor to the cars A to C.

Consider now the car A alone. (The same as that described below applied to the other cars.) In response to the origination of the up hall call from the second floor, the relay contact Ry2UA1 is turned on in FIG. 4, and the signal H2UA representative of the number of passengers waiting in the hall of the second floor by originating the up hall call is applied to the circuit of FIG. 5. Therefore, the adders AD2UA1 to AD9UA1 compute the number of predictive passengers in the car A at each of the successive floors due to reception in the car A of the passengers waiting in the hall of the second floor, and the corresponding outputs appear from these adders. Then, these adder outputs are compared with the predetermined setting or voltage VPO in the comparators CM2UA1 to CM9UA1, and the signals AM2U to AM9U appear which are of 1 level when the passengers waiting at the corresponding floors cannot get on the car A.

In the meantime, the relay contact Ry2UA3 is turned on in FIG. 6, and the setting or voltage VAD1 corresponding to the length of time required for the car A to stop at one of the floors is applied to the adder AD2UA2. Therefore, the adders ADD2UA to ADD9DA compute the forecast waiting time at each of the successive floors due to additional stopping of the car A at the second floor, and the corresponding outputs appear from these adders. The relay contact Ry2UA2 is also turned on, and the counter CLW2UA starts to count the length of time elapsed after the origination of the up hall call from the second floor.

The circuit of FIG. 7 determines the serviceability of the car A on the basis of the results of computation above described. Suppose herein that the car A is selected already to service an up hall call from the ninth floor and the relay contact Ry9UA4 is turned on.

The signals AN1UA to AN1ODA representative of the forecast waiting time at each of the ten floors are compared by the comparators CM1UA2 to CM1ODA2 with the predetermined voltage VLO corresponding to the waiting time limit, and those of the analog switches SW1UA to SW1ODA corresponding to the floors at which the waiting time limit is exceeded are turned off. Further, the relay contact Ry9UA4 is turned on already in response to the origination of the up hall call from the ninth floor. Therefore, when the forecast waiting time at the ninth floor, to which the car A is selected already to service, exceeds the waiting time limit, the output of the comparator CM9UA2 is transmitted through the route of Ry9UA4-OR9UA1 F9UA3-OR8UA1 . . . to the floor at which the car A is presently located. The analog switches including SW9UA, SW8UA . . . and that corresponding to the floor at which the car A is presently located are all turned off. As a result, the signal VS2UA indicating the serviceability of the car A for the up hall call from the second floor does not appear.

In the meantime, the signals AM1U to AM1OD for determining as to whether or not the predictive passengers can get on the car A at the corresponding floors are applied to the OR gates OR1UA1 to OR1ODA1. When the predictive passengers at one of the floors are found to be unable to get on the car A, the analog switches SW1UA to SW1ODA are turned off in the range of from this specific floor to the floor at which the car A is presently located.

In this manner, the change in the service condition of the car A after the provisional allotment of the up hall call from the second floor is taken into account in deriving the signals VS1UA to VS1ODA which determine the serviceability of the car A for the 1st to 10th floors. It will be understood from the above description that the signal VS2UA indicating the serviceability of the car A for the up hall call from the 2nd floor appears when the change in the service condition of the car A after the provisional allotment of the up hall call from the second floor satisfies the predetermined conditions, and, in this case, this signal VS2UA is the same as the signal AN2UA representative of the forecast waiting time at the 2nd floor.

Suppose that an up hall call is originated from the 2nd floor and provisionally allotted to the car A, then the predetermined conditions in the present embodiment are as follows:

1. All the passengers originating the up hall call and waiting in the hall of the 2nd floor can get on the car A.
2. The forecast waiting time at the 2nd floor is less than the predetermined setting.
3. All the passengers waiting in the hall of the floors from which hall calls have been originated and allotted already to the car A can get on the car A. That is, the number of predictive passengers in the car A at each of these floors must not exceed the loading limit even when the passengers get on the car A at the second floor.
4. The forecast waiting time is less than the waiting time limit at each of the floors from which the hall calls have been originated and allotted already to the car A.

The above manner of computation is carried out for each car to derive the signals VS2UA to VS2UC determining the serviceability of the cars A to C for the up hall call from the second floor. These signals VS2UA to VS2UC are applied to the circuit of FIG. 8, and one of the cars is selected which is suitable for servicing the up hall call from the second floor and provides a minimum forecast waiting time, as described with reference to FIG. 8. In response to the selection of the car for servicing this up hall call, the corresponding one of the car selection decision signals L2UA to L2UC takes a 1 level. The signals L2UA, L2UB and L2UC in FIG. 8 and the output signal AS2U of the timer TX in FIG. 10 are applied to the AND gates A1A, A1B and A1C in FIG. 11 which gates are associated with the cars A, B and C respectively.

The timer TX in FIG. 10 has such an operating characteristic that an output of 1 level appears in a predetermined length of time after application of an input of 1 level thereto, and the output thereof is changed to a 0 level when the input is changed to 0 level. The timer TX may be set to operate for a length of time greater than the length of time required for the computation by the circuits of FIGS. 3 to 12. This timer setting may commonly be of the order of several msec when integrated circuits are employed although it is variable slightly depending on the circuit structure. Thus, the output AS2U of 1 level appears from the timer TX after the signal SAS2U of 1 level appears to allot provisionally the up hall call from the second floor to all the cars and a length of time elapses which is sufficient for the circuits of FIGS. 3 to 12 to carry out the computation in the manner described. This signal SAS2U is used for allotment of the hall call in a manner as described below.

The output of the AND gate A4 which provides the other input to the AND gates A1A, A1B and A1C in FIG. 11 is in a 1 level as described previously. Therefore, when the output AS2U of 1 level appears from the timer TX, only one of the AND gates A1A, A1B and A1C corresponding to the 1 level of the signals L2UA, L2UB and L2UC in FIG. 8 delivers an output of 1 level.

Suppose, for example, that the up hall call from the second floor is allotted provisionally to all the cars and the car A is selected and decided to service this up hall call as a result of the computation by the circuits of FIGS. 3 to 8 as above described. Then, the signal L2UA is in a 1 level, and the output of the AND gate A1A is solely in a 1 level. The output of the AND gate A1A is applied to the AND gate A2A through the OR gate O1A. The other input HC2U to the AND gate A2A is in a 1 level due to the fact that the up hall call is registered at the 2nd floor. Therefore, the allotment decision signal LL2UA which is the output of the AND gate A2A is in a 1 level. The output of the AND gate A2A provides also the other input to the OR gate O1A so that the signal LL2UA is maintained in the 1 level so long as the signal HC2U remains in the 1 level. This signal LL2UA indicates that the car A is decided to service the up hall call from the second floor.

The allotment decision signal LL2UA is applied to the OR gate O2, and an output of 1 level appears from the OR gate O2 to be applied to the NOT gate N3. An output of 0 level appears from the NOT gate N3 to inhibit the AND gate A4. Therefore, the output signal IAS2U of the AND gate A4 is changed to a 0 level. Thus this signal IAS2U acts to inhibit the AND gates A1A, A1B and A1C and acts also to interlock so that the up hall call from the second floor may not be allotted to the other cars.

The output signal AS2U of 1 level appearing from the timer TX in FIG. 10 is applied to the AND gate A3 together with the output signal S2U of 1 level appearing from the ring counter in FIG. 9. Thus, an output of 1 level appears from the AND gate A3 to be applied to the timer TX through the OR gate O1 to maintain the output signal AS2U of the timer TX in the 1 level.

The output signal AS2U of 1 level appearing from the timer TX is applied to the NOT gate N2. An output of 0 level appears from the NOT gate N2 to be applied to the AND gate A1 together with the signal IAS2U of 0 level (FIG. 11) to inhibit the AND gate A1. As a result, an output of 0 level appears from the AND gate A1, and an output of 1 level appears from the NOt gate N1. The clock pulse signal CP passes through the AND gate A2 to appear as the clock signal CPF by which the ring counter in FIG. 9 is placed in operation again. The output of the AND gate A3 is changed to the 0 level when the signal S2U indicating origination of the up hall call from the second floor is changed to the 0 level. The output signal SAS2U of the OR gate O1 and the output signal AS2U of the timer TX are thus changed to the 0 level.

When the instruction signal SAS2U for provisionally allotting the up hall call from the second floor to the car A is changed to the 0 level, the output signals B2UB and B2UC of the respective OR gates O2B and O2C in FIG. 11 are changed to the 0 level, while the output signal B2UA of the OR gate O2A remains in the 1 level due to the application of the signal of 1 level thereto. Therefore, the allotting relays Ry2UB and Ry2UC in FIG. 12 are deenergized, and the allotting relay Ry2UA associated with the car A is solely energized. Thus, the car A is decided to service the up hall call from the second floor.

Figure 13:
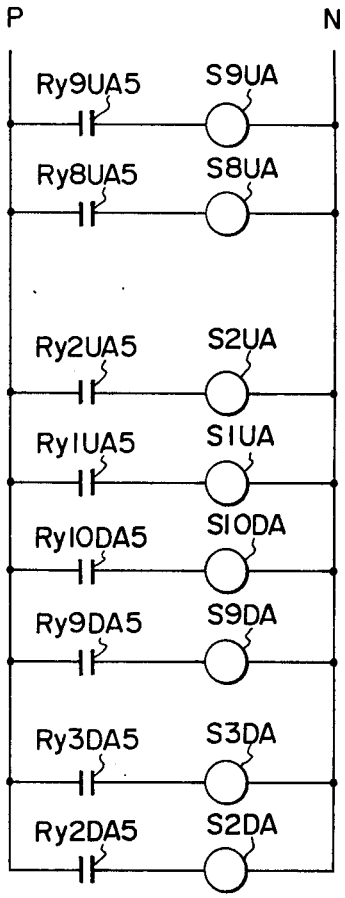
FIG. 13 shows a display circuit to display that the elevator car A is selected to service, such circuit being provided for each of the elevator cars.

A display circuit for the car A is shown in FIG. 13. This circuit informs the passengers waiting in the hall of the fact that the car A is decided to service the hall calls. It is apparent that similar circuits are provided for the cars B and C. Display lamps S1UA to S1ODA are provided for the respective floors and for each of the moving directions. Relay contacts Ry1UA5 to Ry1ODA5 of allotting relays similar to those shown in FIG. 12 are provided. When the car A is decided to service the up hall call from the second floor as described above, the contact Ry2UA5 of the allotting relay Ry2UA is turned on. As a result, the display lamp S2UA disposed at the landing of the second floor for the car A is lit to inform the passengers waiting in the hall of the fact that the car A is decided to service this up hall call. The allotting relays Ry2UA to Ry2UC in FIG. 12 are temporarily energized during the process of provisional hall call allotment and necessary computation for deciding the car which should respond to the up hall call. Thus, all the display lamps S2UA to S2UC associated with the respective cars A to C are temporarily energized. However, energization of all these display lamps may be undesirable in view of the purpose of the indication of the specific car which services the hall call. In order to prevent energization of all the display lamps during the process of provisional allotment and necessary computation, the output signal of, for example, the timer TX in FIG. 10 may be utilized to energize the specific one of the display lamps by detecting the decision of the specific car which services the hall call.

It will be understood from the foregoing detailed description of the first embodiment of the present invention that, in response to the origination of a new hall call, the change in the service condition of each car due to allotment of such new hall call thereto is also taken into account to decide the car which is most suitable for servicing the hall call. Therefore, occurrence of an undesirable situation resulting from the allotment of such new hall call can be completely obviated. For example, impossibility of servicing the allotted hall call, an undesirable increase in the waiting time, and a confusing change of the display by the display lamps can be obviated. Further, the passengers can enjoy good service offered by the elevator since the waiting time for the passengers waiting in the hall of each floor can be averaged and shortened. Thus, according to the present invention, satisfactory elevator control can be attained which is quite efficient and provides very good service for the passengers.

In the present invention, the change in the service condition of each car after allotment of a newly originated hall call is taken into account or computed to decide the car which is most suitable for servicing the new hall call. The present invention as such is in no way limited to the embodiment above described. For example, all the afore-mentioned predetermined conditions (1) to (4) are not necessarily required for finding the change in the service condition after the allotment of the new hall call. When the number of predictive passengers in the car need not be detected, it is apparent that the condition (2) or (4) may only be considered to attain a considerable effect.

Further, in the first embodiment of the present invention, the car which provides a minimum forecast waiting time among the cars satisfying the predetermined conditions is selected and decided to service a new hall call. However, this is not the sole essential requirement and, for example, the car in the which the number of predictive passengers is a minimum among the cars satisfying the predetermined conditions may be selected and decided to service the new hall call. It is further apparent that the illustrated circuit structure may be suitably modified to attain the effect similar to that above described.

Another embodiment of the present invention will be described with reference to FIGS. 14 to 22.

The basic principle of this second embodiment will be described with reference to FIG. 1 again before describing the structure and operation thereof in detail.

As described already, the total length of time required for the car A to service an up hall call from the fifth floor is estimated to be 16 seconds, while that for the car B is estimated to be 2 seconds. Therefore, the car B can service this hall call earlier than the car A. However, up hall calls from the seventh, eighth and ninth floors have already been allotted to the car B. Thus, when the car B is selected to service the up hall call from the fifth floor, the lengths of time for which the passengers must wait at the seventh, eighth and ninth floors are extended by 10 seconds respectively. That is, a total of 30 seconds is estimated to be increased. On the other hand, no up hall calls from the floors remote from the fifth floor in the moving direction of the car A are allotted to the car A, and thus, an up hall call from the third floor is not affected in any way by hall call from the fifth floor even when this latter hall call is allotted to the car A. Therefore, allotment of the up hall call from the fifth floor to the car B, which is expected to arrive at the fifth floor earlier than the car A, results in an increase in the whole waiting time compared with the case in which such hall call is allotted to the car A. This increase is given by $$(t_B^5 - t_A^5) + \left(\Delta \sum_{kB} t_k - \Delta \sum_{kA} t_k\right)$$

$$= (2 - 16) + (30 - 0) = 16 \text{ seconds}$$

where $t_A^5$ is the forecast length of time required for the car A to arrive at the fifth floor, $t_B^5$ is the forecast length of time required for the car B to arrive to the fifth floor, $$\Delta \sum_{kA} t_k$$

is the forecast increment of the waiting time at the already allotted floors due to the allotment of the up hall call from the fifth floor to the car A, and $$\Delta \sum_{kB} t_k$$

is the forecast increment of the waiting time at the already allotted floors due to the allotment of the up hall call from the fifth floor to the car B.

Therefore, the average waiting time at the already allotted floors is greater when the up hall call from the fifth floor is allotted to the car B than when it is allotted to the car A.

According to the second embodiment of the present invention, there is provided an elevator control system which can shorten the waiting time at each of the hall call originating floors thereby offering good elevator service.

The hall call allotting method according to this second embodiment is featured by the fact that an increase in the length of time required for each car to service hall calls allotted already thereto due to provisional allotment of a new hall call thereto is forecast and this forecast increase in the length of time is taken into account to allot the new hall call to one of cars so as to minimize the forecast average waiting time at all the hall calls originating floors.

Suppose that there are three elevator cars A, B and C, and a hall call is originated from an ith floor of a building having ten floors to be allotted to one of the cars. Then, the minimum forecast average waiting time is given by $$\text{Min}\{\overline{W_A^i}, \overline{W_B^i}, \overline{W_C^i}\} \quad (1)$$

where $\overline{W_A^i}$ is the forecast average waiting time at all the hall call originating floors when the hall call from the ith floor is allotted to the car A, $\overline{W_B^i}$ is the forecast average waiting time at all the hall call originating floors when the hall call from the ith floor is allotted to the car B, and $\overline{W_C^i}$ is the forecast average waiting time at all the hall call originating floors when the hall call from the ith floor is allotted to the car C.

The hall call originated from the ith floor is allotted to the car which satisfies the expression (1). Since there occurs a change in the forecast waiting time at the floors to be serviced by the car to which the hall call originated from the ith floor is allotted, $\overline{W_A^i}$ can be expressed as follows:

$$\overline{W_A^i} = W_A^i/N$$

$$= \left(\sum_{kA} t_{Ak1}^i + \sum_{kB} t_{Bk1}^i + \sum_{kC} t_{Ck1}^i\right)/N$$

$$= \left\{\left(t_{Ai}^i + \sum_{kA} t_{Ak2}^i\right) + \sum_{kB} t_{Ak1}^i + \sum_{kC} t_{Ak1}^i\right\}/N$$

where $W_A^i$ is the sum of the forecast waiting time at all the hall call originating floors when the hall call from the ith floor is allotted to the car A $$\left(= \sum_{kA} t_{Ak}^i + \sum_{kB} t_{Ak}^i + \sum_{kC} t_{Ak}^i\right),$$

$N$ is the number of all the hall calls including the hall call from the ith floor, $$\sum_{kA} t_{Ak1}^i$$

is the sum of the forecast waiting times at the hall call originating floors allotted to the car A when the hall call from the ith floor is allotted to the car $$\left(= t_{Ai}^i + \sum_{kA} t_{Ak2}^i\right),$$

$$\sum_{kB} t_{Ak1}^i$$

is the sum of the forecast waiting times at the hall call originating floors allotted to the car B when the hall call from the ith floor is allotted to the car A $$\left(= \sum_{kB} t_{Ak}\right),$$

$$\sum_{kC} t_{Ak1}^i$$

is the sum of the forecast waiting times at the hall call originating floors allotted to the car C when the hall call from the ith floor is allotted to the car A $$\left(= \sum_{kC} t_{Ak}\right),$$

$t_{Ai}^i$ is the forecast waiting time at the ith floor when the hall call from the ith floor is allotted to the car A, $$\sum_{kA} t^i_{Akz}$$

is the sum of the forecast waiting times at the hall call originating floors allotted to the car A immediately before the allotment of the hall call from the ith floor to the car A and subject to a change due to the allotment of this hall call to the car A $$\left(= \Delta \sum_{kA} t_A + \sum_{kA} t_{Ak}\right),$$

$$\sum_{kA} t_k$$

is the sum of the forecast waiting times at the hall call originating floors allotted to the car A immediately before the origination of the hall call from the ith floor, $$\Delta \sum_{kA} t_k$$

is the increment of $$\sum_{kA} t_k$$

due to the allotment of the hall call from the ith floor to the car A.

$$\sum_{kB} t_k$$

is the sum of the forecast waiting times at the hall call originating floors allotted to the car B immediately before the origination of the hall call from the ith floor, $$\sum_{kC} t_k$$

is the sum of the forecast waiting times at the hall call originating floors allotted to the car C immediately before the origination of the hall call from the ith floor, and $W$ is the sum of the forecast waiting times at all the hall call originating floors immediately before the origination of the hall call from the ith floor $$\left(= \sum_{kA} t_k + \sum_{kB} t_k + \sum_{kC} t_k\right).$$

Similarly, $W_B{}^i$ and $W_C{}^i$ are expressed as follows:

$$W^i_B = \left(t^i_{Bi} + \Delta \sum_{kB} t_k + W\right)/N \qquad (3)$$

$$W^i_C = \left(t^i_{Ci} + \Delta \sum_{kC} t_k + W\right)/N \qquad (4)$$

where $t_{Bi}{}^i$ is the forecast waiting time at the ith floor when the hall call from the ith floor is allotted to the car B, $$\Delta \sum_{kB} t_k$$

is the increment of $$\sum_{kB} t_k$$

due to the allotment of the hall call from the ith floor to the car B, $t_{Ci}{}^i$ is the forecast waiting time at ith floor when the hall call from the ith floor is allotted to the car C, and $$\Delta \sum_{kC} t_k$$

is the increment of $$\sum_{kC} t_k$$

due to the allotment of the hall call from the ith floor to the car C.

In the selection of a minimum, the relative magnitude is not changed by multiplying the terms in the expression (1) by a constant or subtracting a constant therefrom. Thus, the expression (1) can be expressed as follows on the basis of the equations (2) to (4):

$$Min\left\{\overline{W^i_A}, \overline{W^i_B}, \overline{W^i_C}\right\}$$

$$= Min\left\{\overline{W^i_A} \times N - W, \overline{W^i_B} \times N - W, \overline{W^i_C} \times N - W\right\}$$

$$= Min\left\{t^i_{Ai} + \Delta \sum_{kA} t_k, t^i_{Bi} + \Delta \sum_{kB} t_k, t^i_{Ci} + \Delta \sum_{kC} t_k\right\} \qquad (5)$$

It will be thus be seen that the elevator control according to the present invention can be simply realized on the basis of the equation (5) by allotting the hall call from the ith floor to the car in which the sum of the forecast waiting time at the ith floor and the increment of the forecast waiting time at each of the already allotted floors due to the allotment of the hall call from the ith floor is a minimum among similar values of all the cars.

The terms $t_{Ai}{}^i$, $t_{Bi}{}^i$, $t_{Ci}{}^i$, $$t^i_{Ai}, t^i_{Bi}, t^i_{Ci}, \Delta \sum_{kA} t_k, \Delta \sum_{kB} t_k$$

and $$\Delta \sum_{kC} t_k$$

in the equation (5) can be expressed as follows when the number of hall calls and the number of cage calls are taken into account:

In the case of the car A, $$t_{Ai}{}^i = f_A{}^i \times T_R + (n_{Ai}{}^i + n_{Az}{}^i) \times T_S \qquad (6)$$

$$\Delta \sum_{kA} t_k = \begin{cases} n_{A3}^i \times T_S & \text{(when no cage call for the ith floor is registered in the car A)} \\ 0 & \text{(when a cage call for the ith floor is registered in the car A).} \end{cases} \quad (7)$$

In the equations (6) and (7), $f_A^i$ is the number of floors existing between the ith floor and the floor at which the car A is presently located, $n_{A1}^i$ is the number of cage calls registered in the car A for the floors between the ith floor and the present location of the car A, $n_{A2}^i$ is the number of hall calls originating from the floor range between the ith floor and the present location of the car A and allotted to the car A, $n_{A3}^i$ is the number of hall calls originated from the floors remote from the ith floor in the moving direction of the car A and allotted to the car A.

$T_R$ is the length of time required for the car to run one floor interval, and $T_S$ is the length of time required for the car to stop at one of the floors.

The elevator control according to the second embodiment of the present invention is carried out in a manner as described below. The physical position of each elevator cars, the number of hall calls for each car, the number of cage calls in each car, the number of passengers waiting in the hall of each of the floors, and the number of passengers in each car are detected to forecast and determine as to whether a *j*th car can service an ith floor. Further, the distance between the ith floor and the present location of the *j*th car, the number of hall calls originated from the floor range between the ith floor and the present location of the *j*th car and allotted thereto, and the number of cage calls registered in the *j*th car for the floors between the ith floor and the present location of the *j*th car, are detected to forecast the length of time required for this car to arrive at the ith floor, thereby computing the forecast waiting time $t_j^i$ at the ith floor. Further, the number of hall calls originated from the floors remote from the ith floor in the moving direction of the *j*th car and allotted already to the *j*th car, and the presence or absence of a cage call for the *i*th floor in the *j*th car, are detected to forecast the increment of the waiting time at each of the floors allotted already to the *j*th car when the hall call from the *i*th floor is allotted to the *j*th car, thereby computing the increment of the forecast waiting time $$\Delta \sum_{kj} t_k.$$

The car is selected to service the *i*th floor when the sum of $t_j^i$ and $$\Delta \sum_{kj} t_k$$

is a minimum among similar values of all the cars which are found to be suitable for servicing the *i*th floor. Therefore, in response to the origination of the hall call from the *i*th floor, this hall call is allotted to the selected car. It will thus be seen that a new hall call is allotted to the car which provides a minimum forecast average waiting time at all the hall call originating floors when computed in the manner above described, among the cars which are found to be suitable to service this new hall call without giving rise to an excessively long waiting time and without being loaded to the full capacity thereof.

Figure 14:
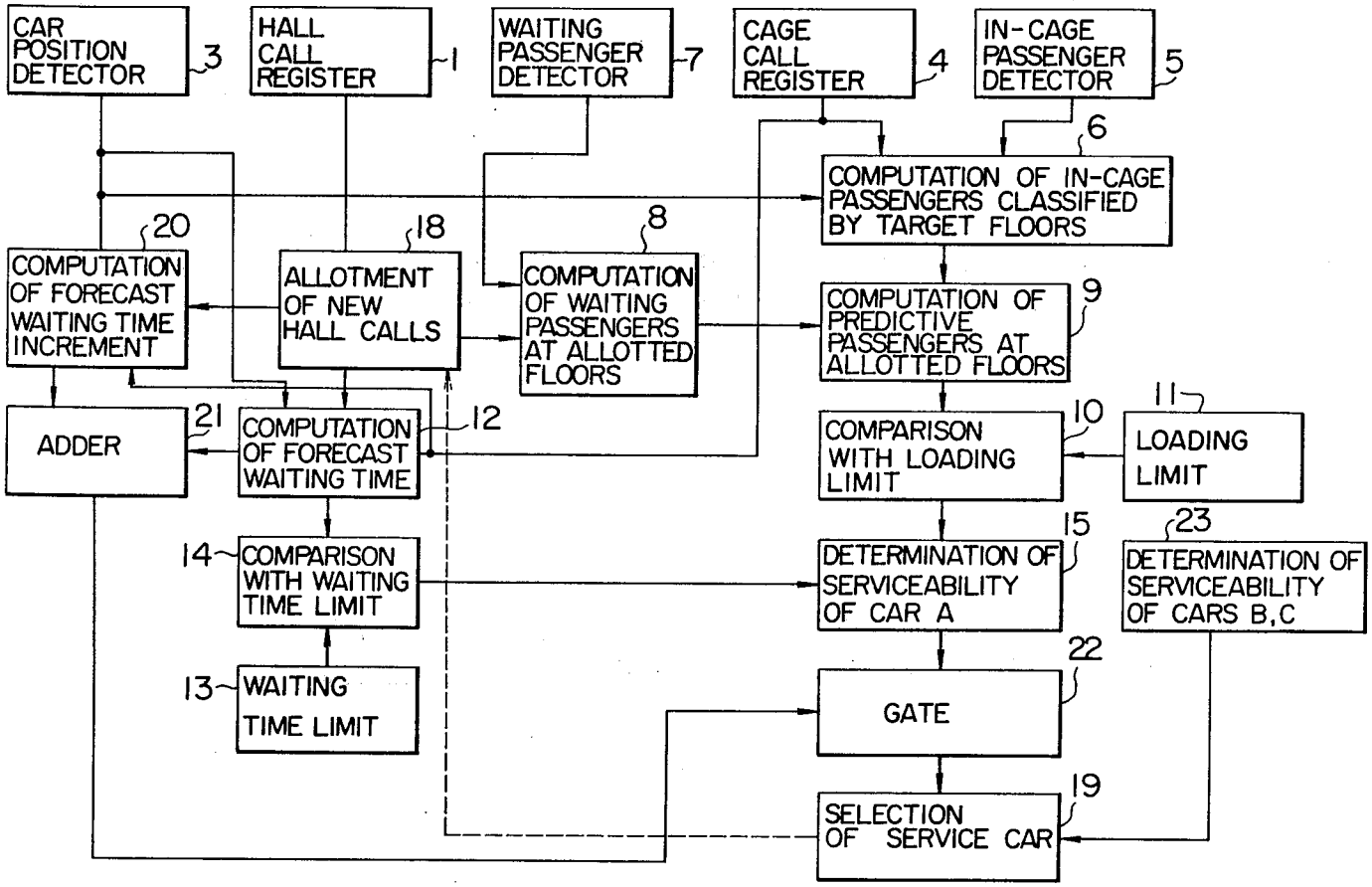
FIG. 14 is a block diagram of another embodiment of the present invention the details of which are shown in FIGS. 15 to 22.

FIG. 14 is a block diagram showing the general structure of this second embodiment of the present invention, and like reference numerals are used therein to denote like parts appearing in FIG. 2. Therefore, the block representing the specific features of this embodiment will be exclusively described.

An allotting device 18 in FIG. 14 differs slightly from the device 2 shown in FIG. 2 in that it does not possess the function of provisional allotment of a new hall call to all the cars. This allotting device 18 possesses merely a function of allotting a new hall call to the car which is selected and decided to service this new hall call by a servicing car selecting and deciding device 19.

A device 20 for computing the increment of the forecast waiting time is provided for each car. Signals representative of the physical position of the car, the number of hall calls allotted to the car and the number of cage calls registered in the car are applied to the forecast waiting time increment computing device 20. In response to the application of these signals, the device 20 computes the increment of the forecast waiting time at each of the floors allotted already to the car when a new hall call is additionally allotted thereto. An adder 21 adds the output of the device 20 representative of the increment of the forecast waiting time to the output of a device 12 which computes the forecast waiting time, and the resultant output of the adder 21 is applied to a gate 22. When the car is determined to be suitable for servicing the new hall call by a device 15, the output of the adder 21 passes through the gate 22 to be applied to the servicing car selecting and deciding device 19. In the device 19, the output of the gate 22 is compared with the output of a similar computing device 23 provided for each of the remaining cars, and the car in which this value is a minimum is selected and decided to service the new hall call. The information of the car thus decided to service the new hall call is applied from the device 19 to the allotting device 18 so that this new hall call can be allotted to the car which is selected and decided to service the floor from which the new hall call is originated.

It will be seen from the above description, that, in the second embodiment of the present invention, the number of predictive passengers at each of the floors and the forecast waiting time subject to a change due to the allotment of a new hall call are not computed, but the increment of the forecast waiting time due to the allotment of such hall call is merely computed to select the car which services the floor from which this new hall call is originated. However, in this second embodiment too, a device similar to the device 2 shown in FIG. 2 may be employed to compute the values including the number of predictive passengers at each of the floors and the forecast waiting time which are subject to a change due to the allotment of the new hall call. This point is however apparent from the first embodiment, and the practical structure of the new components in FIG. 14 will only be described in detail to avoid repetition of the same description.

It will be apparent from comparison of the block diagrams of FIGS. 2 and 14 that the practical structure of this second embodiment is substantially the same as that of the first embodiment. Therefore, the structure of the second embodiment including the additional circuits may be described while referring to the description of the structure of the first embodiment. However, for the purpose of illustration of another and suitable structure of the present invention and clear understanding of the second embodiment, the practical structure of all the circuits will be described again. The same circuits as those shown in FIGS. 3 and 4 are employed in the present embodiment, and therefore, any detailed description thereof is unnecessary.

Figure 15:
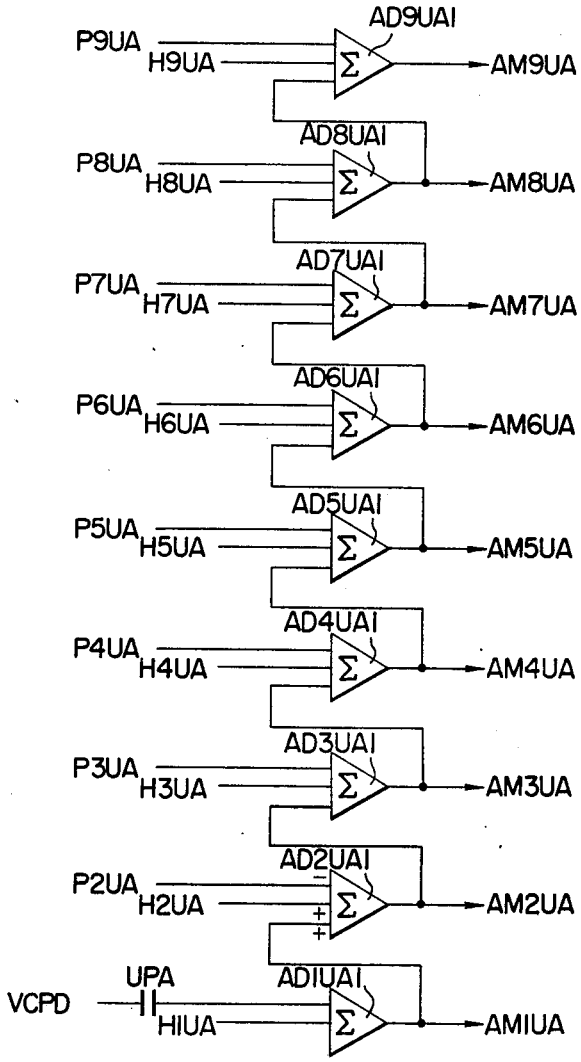
FIG. 15 shows a circuit for computing the number of prospective passengers in the elevator car A at each of the successive floors when the elevator car A shows upward, such circuit being provided for each of the elevator cars and each of the moving directions.

FIG. 15 shows a circuit for computing the number of predictive in-cage passengers classified by their target floors. This circuit is provided to operate during the upward movement of the car A, and it is apparent that a circuit similar to that is also provided to operate during the downward movement of the car A, and similar circuits are also provided for the other cars B and C. The circuit shown in FIG. 15 is quite analogous to that shown in FIG. 5 or entirely the same as the latter circuit except that the comparators CM2UA1 to CM9UA1 are eliminated. Thus, as described with reference to FIG. 5, output signals AM1UA to AM9UA of respective adders AD1UA1 to AD9UA1 are each representative of the number of predictive passengers at the successive floors. The same reference numerals are used in FIG. 15 to denote the same parts appearing in FIG. 5.

Figure 16:
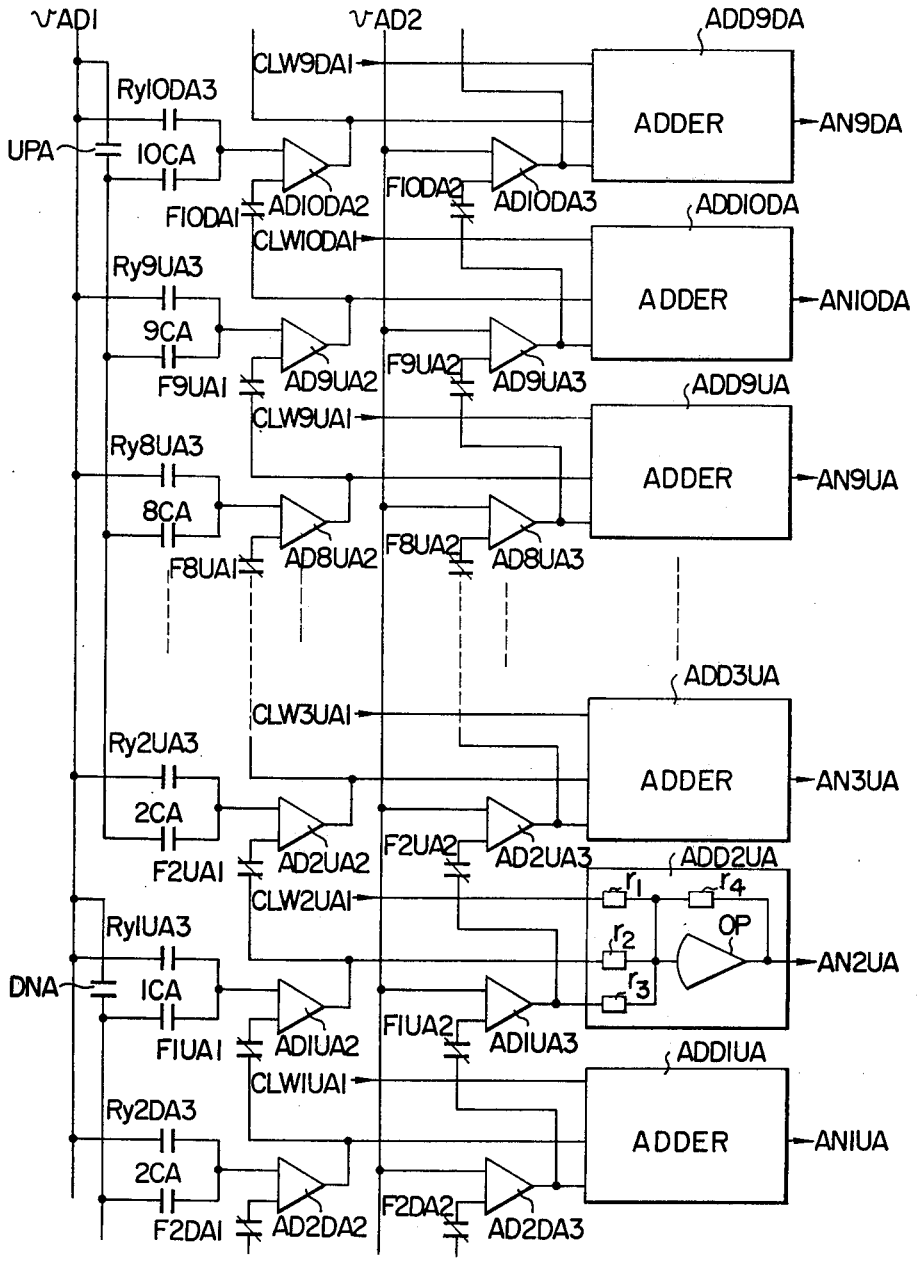
FIG. 16 shows a circuit for computing the forecast waiting time at each of the successive floors when the elevator car A moves upward, such circuit being provided for each of the elevator cars and each of the moving directions.

FIG. 16 shows a circuit for computing the forecast waiting time at each of the successive floors when the car A moves upward. It is apparent that a circuit similar to that is also provided to operate during the downward movement of the car A, and similar circuits are also provided for the other cars B and C. The circuit shown in FIG. 16 is also quite analogous to that shown in FIG. 6, and the same reference numerals are used to denote the same parts operating in the same manner in FIG. 6. Therefore, any detailed description of this circuit is unnecessary.

Figure 17:
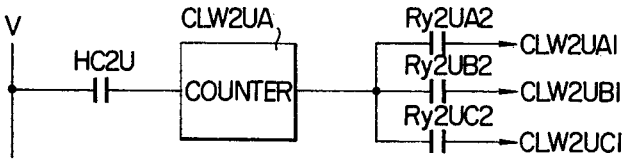
FIG. 17 shows a circuit for detecting the elapsed time after origination of an up hall call from the second floor, such circuit being provided for each of the hall calls.

The circuit shown in FIG. 16 is actually entirely the same as that shown in FIG. 6 except that the allotting relays Ry9UA2 to Ry9UA2, Ry9DA2, Ry10DA2 and counters CLW1UA to CLW9UA, CLW9DA, CLW10DA are eliminated. In the case of the circuit shown in FIG. 16, the length of time elapsed after the origination of a new hall call is detected by a circuit as shown in FIG. 17, and signals CLW1UA1 to CLW9UA1, CLW9DA1 and CLW10DA1 each representative of the elapsed time are applied from the circuit of FIG. 17 to respective adders ADD1UA to ADD9UA, ADD9DA and ADD10DA in FIG. 16. Therefore, the output signals AN1UA to AN9UA, AN9DA and AN10DA of the respective adders are each representative of the forecast waiting time for which the passengers at the successive floors must wait until the car A arrives at these floors.

FIG. 17 shows a circuit for detecting the length of time elapsed after the origination of a new hall call as described. The circuit shown in FIG. 17 is provided to operate in response to an up hall call originated from the 2nd floor, and it is apparent that similar circuits are further provided. A relay contact HC2U in FIG. 17 is turned on in response to the origination of an up hall call from the 2nd floor. Therefore, as soon as this up hall call is originated, a counter CLW2UA starts to count the length of time elapsed thereafter. Then, one of allotting relay contacts Ry2UA2 to Ry2UC2 corresponding to the car to which the hall call is allotted is turned on to apply to the selected car the signal representative of the elapsed time. This arrangement is advantageous in that the counter CLW2UA can be used in common to all the cars. (In the first embodiment, such counter is required for each of the cars. ) Further, due to the fact that counting of the elapsed time is started as soon as the hall call is originated, accurate counting can be attained even when allotment of the hall call is delayed for some reasons. (In the first embodiment, counting of the elapsed time is started after the allotment of the hall call.)

Figure 18:
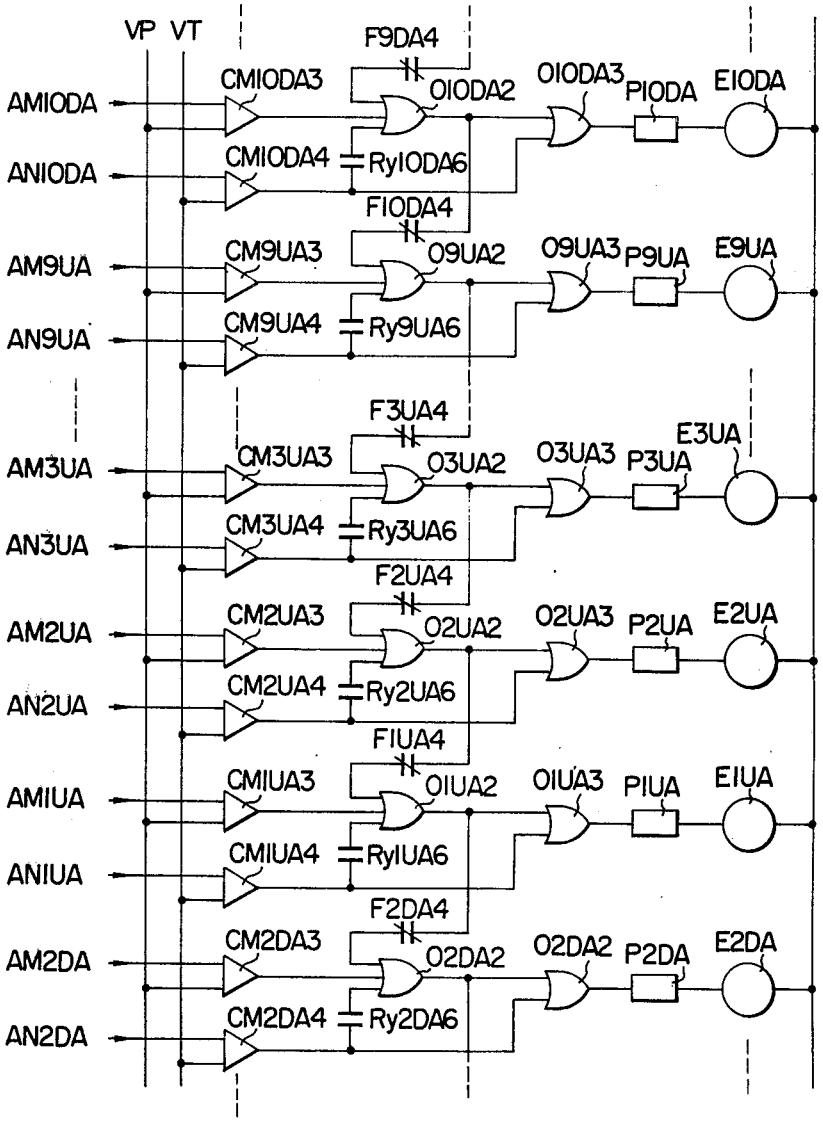
FIG. 18 shows a circuit for determining the serviceability of the elevator car A, such circuit being provided for each of the elevaotr cars.

FIG. 18 shows a circuit for determining the serviceability of the car A on the basis of the outputs of the circuits shown in FIGS. 15 and 16. The circuit shown in FIG. 18 is provided to operate during the upward movement of the car A, and it is apparent that such circuit is also provided to operate during the downward movement of the car A, and similar circuits are also provided for the cars B and C. The circuit shown in FIG. 18 corresponds partly to the circuit shown in FIG. 7.

Referring to FIG. 18, a predetermined voltage VP representative of the loading limit of the car A and another predetermined voltage VT representative of the waiting time limit are applied to the circuit as reference voltages for determining the serviceability of the car A. Suppose, for example, that the car A is located at the 1st floor for upward movement an up hall call is originated from the third floor. A signal AM3UA representative of the number of predictive in-cage passengers at the third floor appears. Suppose that this signal AM3UA such a voltage level that the loading limit of the car A will be exceeded when the passengers originating the up hall call and waiting in the hall of the third floor get on the car A. This voltage level of the signal AM3UA proportional to the number of predictive in-cage passengers at the third floor is compared with the reference voltage VP by a comparator CM3UA3. The output of the comparator CM3UA3 is applied through OR gates 03UA2 and 03UA3 to an amplifier P3UA to be amplified thereby for energizing a relay E3UA. The output of the OR gate 03UA2 is applied through a position relay contact F2UA4, OR gate 02UA2 and 02UA3 and another amplifier P2UA to another relay E2UA to energize the same. Similarly, another relay E1UA is also energized. However, other relays are not energized due to the fact that the car A is located at the 1st floor for upward movement and a position relay contact F1UA4 is in the off position. Thus, the car located at the 1st floor for upward movement is determined to be incapable of servicing the up hall call from the third floor.

Further, suppose, for example, that the forecast waiting time at the third floor from which an up hall call is originated and allotted to the car A is greater than the waiting time limit. A signal AN3UA having a voltage level proportional to this forecast waiting time at the 3rd floor originating the up hall call is applied from the circuit of FIG. 16 to be compared with the reference voltage VT by a comparator CM3UA4, and an output of 1 level appears from the comparator CM3UA4. Due to the fact that the up hall call from the third floor is allotted already to the car A and an allotting relay contact Ry3UA6 is in the on position, the output of 1 level from the comparator CM3UA4 is applied through the relay contact Ry3UA6 and OR gate 03UA2, 03UA3 or directly through the OR gate 03UA3 to the amplifier P3UA to be amplified thereby for energizing the relay E3UA. The relays E2UA and E1UA are also similarly energized. Thus, the car A located at the 1st floor for upward movement is determined to be incapable of servicing the up hall call from the third floor.

Further, suppose, for example, that the forecast waiting time at the third floor exceeds the waiting time limit although an up hall call originated from the third floor is not yet allotted to the car A. The signal AN3UA having the voltage level proportional to the forecast waiting time at the third floor is compared by the comparator CM3UA4 with the reference voltage VT, and an output of 1 level appears from the comparator CM3UA4. The output of 1 level from the comparator CM3UA4 is applied through the OR gate 03UA3 to the amplifier P3UA to be amplified thereby for energizing the relay E3UA. However, due to the fact that the up hall call from the third floor is not yet allotted to the car A and the allotting relay contact Ry3UA6 is in the off position, the output of 1 level from the comparator CM3UA4 is not applied to the OR gate O3UA2 unlike the cases above described, and therefore, the relay E3UA is solely energized. Thus, the car A located the 1st floor for upward movement is determined to be incapable of servicing the up hall call from the third floor even when such call is allotted thereto.

Figure 19:
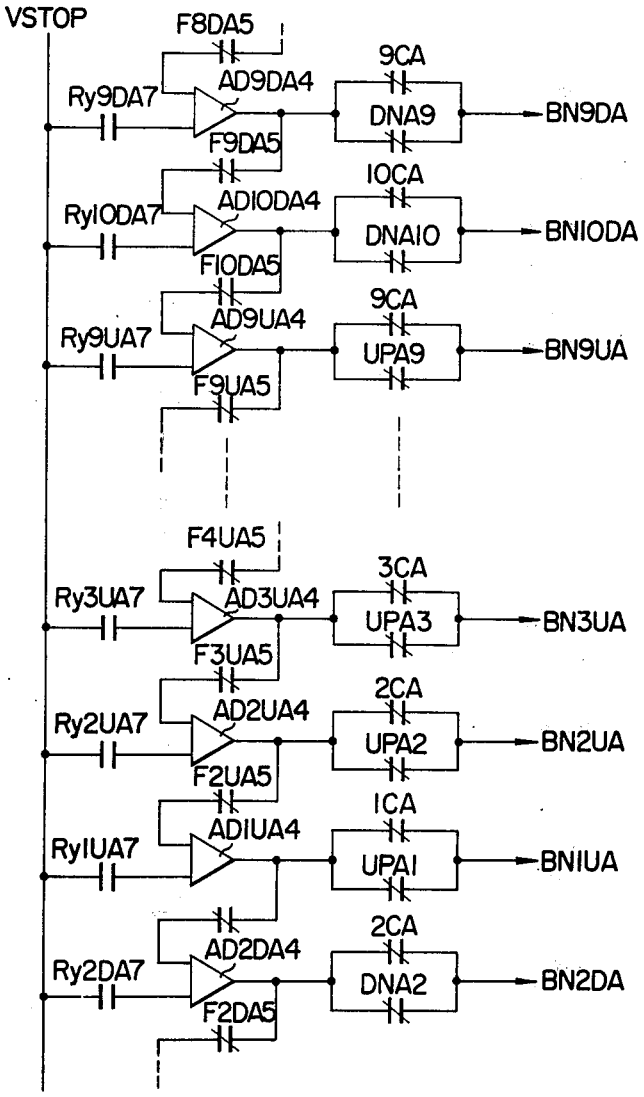
FIG. 19 shows a circuit for computing the increment of the forecast waiting time at each of the successive floors to be serviced by the elevator car A, such circuit being provided for each of the elevator cars.

FIG. 19 shows a circuit for computing the increment of the forecast waiting time when a new hall call is alloted to the car A. It is apparent that such circuits are also provided for the cars B and C. Referring to FIG. 19, the symbol VSTOP designates a voltage which is proportional to the length of time required for each car to stop at one of the floors. This length of time includes that required for the acceleration and deceleration of the car, that required for the opening and closing of the car door, and that required for the passengers to get off and on the car. Commonly, this voltage has a value corresponding to the length of time of about 10 seconds, but it may be a value proportional to the operating characteristic of the car or the average number of passengers who get off and on the car.

Suppose, for example, that the car A is located at the 1st floor for upward movement, up hall calls from the second and ninth floors are allotted to the car A, and no cage calls are registered in the car A. Due to the allotment of the up hall call from the ninth floor to the car A, an allotting relay contact Ry9UA7 is turned on and the voltage VSTOP is applied through this relay contact Ry9UA7 to an adder AD9UA4. The output of the adder AD9UA4 appears through a cage call relay contact 9CA as a signal BN9UA having a voltage level equal to VSTOP. The output of the adder AD9UA4 is also applied through another relay contact F9UA5 to another adder AD8UA4 associated with an up hall call from the 8th floor. The output of the adder AD8UA4 appears through another cage call relay contact 8CA as a signal BN8UA having a voltage level equal to VSTOP. Similarly, signals BN7UA to BN3UA having a voltage level equal to VSTOP appear in the same manner. The output of the adder AD3UA4 is applied through another relay contact F3UA5 to another adder AD2UA4 associated with an up hall call from the second floor. Due to the fact that the up hall call from the second floor is allotted to the car A and an allotting relay contact Ry2UA7 is in the on position, the output of the adder AD3UA4 is added to the voltage VSTOP by the adder AD2UA4, and the output of the adder AD2UA4 appears through another relay contact 2CA as a signal BN2UA having a voltage level equal to 2 × VSTOP. The output of the adder AD2UA4 is applied through another relay contact F2UA5 to another adder AD1UA4 associated with an up hall call from the 1st floor, and the output of the adder AD1UA4 appears through another relay contact 1CA as a signal BN1UA having a voltage level equal to 2 × VSTOP. The output of the adder AD1UA4 cannot be applied to another adder AD2DA4 due to the fact that the car A is located at the first floor for upward movement and a relay contact F1UA5 is in the off position. Consequently, other signals BN2DA to BN1ODA have a zero voltage level. Therefore, the waiting time at each of the second and ninth floors originating the allotted up hall calls is not increased even when down hall calls are originated from the floor range between the second floor and the tenth floor and are allotted to the car A. However, the waiting time at each of the second and ninth floors to which the car A is allotted to service is estimated to be increased by the length of time corresponding to two stops when an up hall call originated from the 1st floor is allotted to the car A, and such waiting time is estimated to be increased by the length of time corresponding to one stop when up hall calls originated from the third to eighth floors are allotted to the car A.

Suppose further that a cage call for the third floor is registered in the car A in addition to the up hall calls allotted already to the car A. In this case, a cage call relay contact 3CA is turned off and up relay contacts UPA1 to UPA9 are also turned off. As a result, the output of the adder AD3UA4 does not appear as the signals BN3UA. Thus, this case differs from the previous case in that, even when an up hall call originated from the third floor is allotted to the car A, the waiting time at each of the second and ninth floors to be serviced by the car A is not increased due to the fact that the car A is decided to stop at the third floor for which the cage call is already registered. It will thus be apparent that the signal BN3UA, for example, is representative of the increment of the forecast waiting time at each of the floors allotted already to the car A when a new up hall call from the third floor is allotted to the car A.

Figure 20:
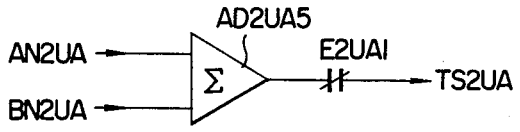
FIG. 20 shows an addition circuit for adding the outputs of the circuits of FIGS. 16 and 19 in response to an up hall call from the second floor when the elevator car A moves upward, such circuit being provided for each of the elevator cars, each of the floors and each of the moving directions.

FIG. 20 shows a circuit for adding the outputs of the ciruits shown in FIGS. 16 and 19. The circuit shown in FIG. 20 is provided for the 2nd floor to operate during the upward movement of the car A. It is apparent that a circuit similar to that shown in FIG. 20 is also provided for the downward movement and for each of the other floors, and similar circuits are also provided for the cars B and C. Referring to FIG. 20, a relay contact E2UA1 is turned off when the car A is determined to be incapable of servicing an up hall call from the second floor and the relay E2UA is energized in FIG. 18. When this relay contact E2UA1 is in the off position, the output TS2UA of an adder AD2UA5 does not appear. This signal TS2UA represents the sum of the signal AN2UA representative of the forecast waiting time at the second floor and the signal BN2UA representative of the increment of the forecast waiting time at the second floor. This output signal TS2UA is applied to a circuit of FIG. 21 when the relay contact E2UA1 is in the on position.

Figure 21:
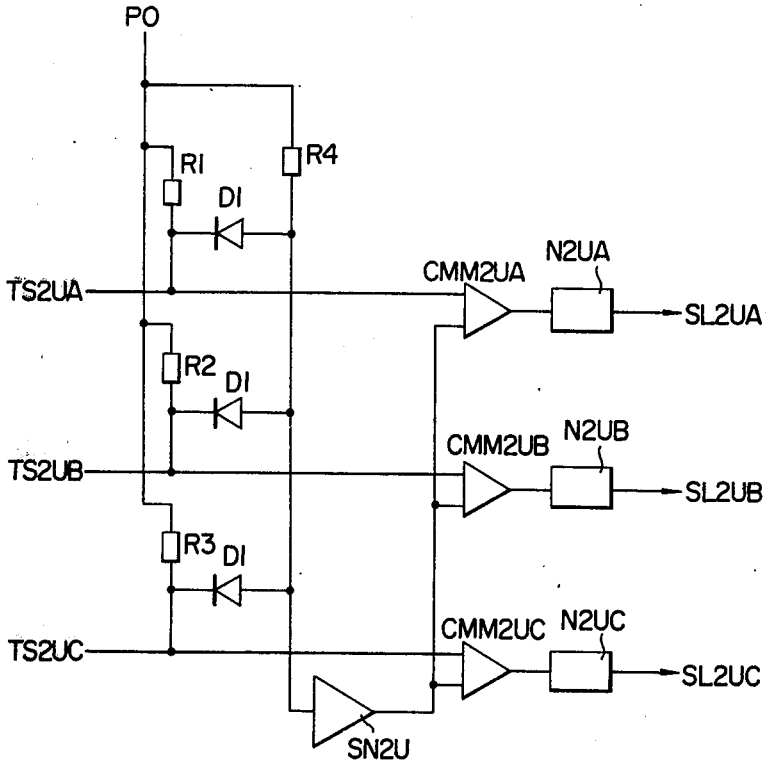
FIG. 21 shows a circuit for selecting the elevator car which can service an up hall call from the second floor, such circuit being provided for each of the floors and each of the moving directions.

FIG. 21 shows a circuit for selecting the car which is suitable for servicing a specific floor by detecting a signal having a minimum level among the output signals of the circuits of the structure shown in FIG. 20. The circuit shown in FIG. 21 is provided for operation in response to the origination of an up hall call from the second floor, and it is apparent that similar circuits are provided for other up hall calls and for down hall calls. The output signals similar to that shown in FIG. 20 are applied to the circuit of FIG. 21 which selects one of the cars A, B and C for the desired service. The circuit shown in FIG. 21 is entirely the same as that shown in FIG. 8, and the same reference numerals are used to denote the same parts appearing in FIG. 8. Therefore, any detailed description of the operation of this cirucit is unnecessary.

The circuit of FIG. 21 selects the car which is determined to be capable of servicing a new up hall call from the second floor and which provides a minimum value among the adder outputs TS2UA, TS2UB and TS2UC each representative of the sum of the forecast waiting time and the increment of the forecast waiting time. More precisely, the result of allotment of the new up hall call from the second floor is computed for each car, and one of the cars is selected which provides a minimum waiting time at each of the floors originating the allotted hall calls, that is, a minimum average waiting time when all the hall calls are considered. One of signals SL2UA, SL2UB and SL2UC appears from the circuit when the corresponding car is selected to service the second floor from which the up hall call is originated.

Figure 22:
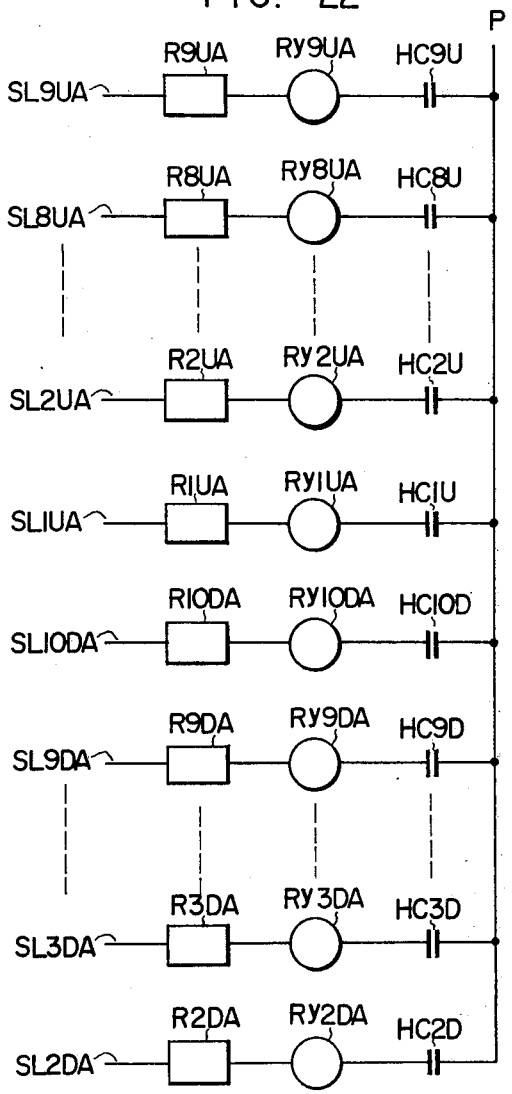
FIG. 22 shows a circuit for allotting hall calls to the elevator car A, such circuit being provided for each of the elevator cars.

FIG. 22 shows a hall call allotting circuit for the car A. It is apparent that similar circuits are also provided for the cars B and C. The circuit of FIG. 22 includes amplifiers R1UA to R9UA and R2DA to R10DA, allotting relays Ry1UA to Ry9UA and R2DA to R10DA, allotting relays Ry1UA to Ry9UA and Ry2DA to Ry10DA of self-holding type, and relay contacts HC1U to HC9U and HC2D to HC10D which are turned on in response to the origination of respective up and down hall calls.

Referring to FIG. 22, the signals SL1UA to SL9UA and SL2DA to SL10DA are applied from the circuits of the structure shown in FIG. 21 when the car A is selected to service up hall calls or down hall calls from the floors. Suppose, for example, that the car A is selected to service an up hall call from the second floor, then the signal SL2UA is applied to the circuit. In response to the origination of the up hall call from the 2nd floor, the relay contact HC2U is turned on to energize the allotting relay Ry2UA, and this relay Ry2UA holds itself over the amplifier R2UA so as to allot the up hall call from the second floor to the car A. Although now shown in FIG. 22, it is necessary to utilize the turn-on of the allotting relay Ry2UA for preventing the up hall call from the second floor from being subsequently allotted to the other cars. This is easily attained by, for example, inhibiting the circuits which allot the up hall call from the second floor to the other cars.

Figure 23:
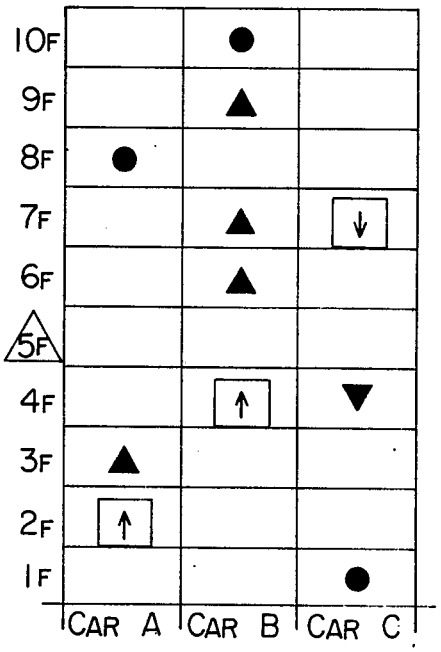
FIG. 23 is a diagrammatic view for illustrating the operation of the second embodiment of the present inventions.

An application of the afore-mentioned embodiment of the present invention to an elevator having three elevator cars A, B and C arranged for parallel operation to service the service floor landings of a building having ten floors will be described with reference to FIG. 23. Referring to FIG. 23, hall calls and cage calls represented by the black triangles and black circles respectively are already allotted to and registered in the cars A, B and C located at the second, fourth and seventh floors respectively for movement as shown by the arrows, and a new up hall call represented by the white triangle is originated from the fifth floor to be allotted to one of the cars. It is supposed herein that the number of forecast passengers and the forecast waiting time described in the embodiment are less than their limits in each of the three cars. It is supposed further that the length of time required for each car to run one floor interval is 2 seconds and the length of time required to stop at one of the floors is 10 seconds as described previously.

In the case of the car A, three floor intervals exist between the present location thereof and the 5th floor originating the new up hall call, and one up hall call originated from the third floor lying between the 2nd floor and the fifth floor is allotted to the car A. Thus, the forecast waiting time $t^5_1$ at the fifth floor is given by $t_A{}^5 = 2 \times 3 + 10 \times 1 = 16$ seconds. Since no halls calls from the floors remote from the fifth floor in the moving direction thereof are allotted to the car A, the increment of the forecast waiting time $$\Delta \sum_{kA} t_k$$

is given by $$\Delta \sum_{kA} t_k = 10 \times 0 = 0 \text{ seconds.}$$

Therefore, $$t^5_A + \Delta \sum_{kA} t_k = 16 \text{ seconds.}$$

In the case of the car B, one floor interval exists between the present location thereof and the 5th floor originating the new up hall call, and neither cage calls nor hall calls are allotted to the car B in this floor range. Thus, the forecast waiting time $t_B{}^5$ is given by $t_B{}^5 = 2 \times 1 + 10 \times 0 = 2$ seconds. Since three up hall calls originated from the sixth, seventh, and ninth floors remote from the fifth floor in the moving direction thereof are allotted to the car B, the increment of the forecast waiting time $$\Delta \sum_{kB} t_k$$

is given by $$\Delta \sum_{kB} t_k = 10 \times 3 = 30 \text{ seconds.}$$

$$\text{Therefore, } t^5_B + \Delta \sum_{kB} t_k = 32 \text{ seconds.}$$

In the case of the car C, 10 floor intervals exist between the present location thereof and the fifth floor originating the new up hall call, and one down hall call from the fourth floor and one cage call for the first floor are allotted to the car C in this floor range. Thus, the forecast waiting time $t_C{}^5$ at the fifth floor is given by $t_C{}^5 = 2 \times 10 + 10 \times 2 = 40$ seconds. Since no hall calls from the floors above the fifth floor are allotted to the car C, the increment of the forecast waiting time $$\Delta \sum_{kC} t_k$$

is given by $$\Delta \sum_{kC} t_k = 10 \times 0 = 0 \text{ seconds.}$$

$$\text{Therefore, } t^5_C + \Delta \sum_{kC} t_k = 40 \text{ seconds.}$$

It is apparent that the sum of the forecast waiting time and the increment thereof is minimum in the case of the car A as it is given by $$t_A^5 + \Delta \sum_{kA} t_k = 16 \text{ seconds},$$

and the new up hall call from the fifth floor is allotted to the car A.

Referring to FIG. 21 again, the input signals TS5UA, TS5UB and TS5UC having voltage levels corresponding to 16 seconds, 32 seconds and 40 seconds respectively are applied to the circuit which selects the car servicing the fifth floor in response to the origination of the new up hall call from the fifth floor. The signal TS5UA having the minimum voltage level among these three signals TS5UA to TS5UC is selected and the signal SL5UA appears from the circuit. This signal SL5UA indicating the selected service car is applied to the hall call allotting circuit shown in FIG. 22. In the circuit of FIG. 22, the relay contact HC5U (not shown) is turned on in response to the origination of the up hall call from the fifth floor, and the allotting relay Ry5UA (not shown) is energized in response to the application of the signal SL5UA. Thus, the up hall call from the fifth floor is allotted to the car A.

Such computation is desirably carried out for each of the floors from which no hall calls are originated, so that, in response to the origination of a hall call from one of these floors, allotment of this hall call to one of the cars can be immediately decided. The car thus selected must generally necessarily service this hall call.

It will be understood from the foregoing detailed description of the second embodiment of the present invention that the control system makes continuous computation to forecast the waiting time at each of the floors from which a new hall call will be originated and to forecast the change in the waiting time at each of the already allotted floors due to registration and allotment of the new hall call to the cars. This new hall call is allotted to the car which provide a minimum waiting time at each of the allotted floors, that is, a minimum average waiting time. Thus, a plurality of elevator cars arranged for parallel operation can be uniformly utilized by the passengers to offer better service for the passengers and the elevator control ensuring a shorter waiting time for all the calls can be provided.

What is claimed is:

1. An elevator control system for controlling a plurality of elevator cars arranged for parallel operation for servicing a plurality of service floor landings of a building, comprising hall call registering means disposed at each floor, cage call registering means disposed in each said car for registering a cage call instructing target floors, means for generating a signal representative of a car position, means for computing the service condition of each said car for hall calls in response to said car position signal, means for selecting suitable ones of said cars for servicing a new hall call, and means responsive to said selecting means for allotting said new hall call to said selected cars, said servicing car selecting means comprising means for computing a forecast of the changed service condition of each said car for the hall calls allotted thereto already when said new hall call originated from one of the floors is provisionally allotted thereto, and means for selecting a car to service said new hall call whose changed service condition for each hall call already allotted thereto falls within acceptable limits.

2. An elevator control system as claimed in claim 1, wherein said service condition computing means comprises means for computing for each said car the forecast waiting time at each of the already allotted floors until arrival of said car at these floors in response to the application of signals including at least a signal representative of the car position and signals representative of the already allotted hall calls, and means for setting the limit of waiting time at the hall call originating floors to be serviced by said selected cars, and said servicing car selecting means comprises means for computing for each said car the forecast waiting time at each of the already allotted floors until arrival of said car at these floors in the case where the new hall call is provisionally allotted to each said car.

3. An elevator control system as claimed in claim 2, wherein said servicing car selecting means further comprises second means for comparing for each said car the forecast waiting time at said new hall call originating floor with said waiting time limit so as to determine the serviceability of said cars for said new hall call.

4. An elevator control system as claimed in claim 3, wherein said servicing car selecting means further comprises means for finding the cars determined to be serviceable for said new hall call by said first and second serviceability determining means, and means for selecting the car which provides a minimum forecast waiting time at said new hall call originating floor among the cars found by said finding means thereby deciding said selected car to service said new hall call.

5. An elevator control system as claimed in claim 1, wherein said service condition computing means comprises means for computing a forecast of the number of passengers in each said car at each of the successive floors to be serviced thereby in response to the application of signals including at least a signal representative of the number of passengers initially present therein and signals each representative of the number of passengers waiting at the already allotted floors, and means for setting the loading limit of the cars, and said servicing car selecting means comprises means for computing a forecast for each said car of the change in the number of passengers therein at each of the already allotted floors when the new hall call is provisionally allotted thereto, and third means for comparing the number of predictive passengers at each said floor with the loading limit so as to determine the serviceability of said cars for said new hall call.

6. An elevator control system as claimed in claim 5, wherein said servicing car selecting means further comprises means for computing a forecast for each said car of the number of passengers therein at said new hall call originating floor when said new hall call is provisionally allotted thereto, and fourth means for comparing for each said car the number of predictive passengers at said new hall call originating floor with said loading limit thereby determining the serviceability of said cars for said new hall call.

7. An elevator control system as claimed in claim 6, wherein there are further provided means for computing for each said car the forecast waiting time at each of the hall call originating floors, said servicing car selecting means further comprises means for finding the cars determined to be serviceable for said new hall call by said first, second, third and fourth serviceability determining means, and means for selecting the car which provides a minimum forecast waiting time at said new hall call originating floor among the cars found by said finding means thereby deciding said selected car to service said new hall call.

8. An elevator control system as claimed in claim 1, wherein said servicing car selecting means comprises for computing, in response to the application of signals including at least signals representative of the already allotted hall calls, to forecast for each said car the increment of the forecast waiting time at each of the already allotted floors when the new hall call is provisionally allotted thereto.

9. An elevator control system as claimed in claim 8, wherein said servicing car selecting means further comprises means for selecting the car which provides a minimum increment of the forecast waiting time among the increments computed on the serviceable cars thereby deciding said selected car to sevice said new hall call.

10. An elevator control system as claimed in claim 8, wherein there is further provided means for computing a forecast for each said car of the waiting time at each of the already allotted floors in response to the application of signals including at least a signal representative of the car position and signals representative of the already allotted hall calls, and said serivicing car selecting means further comprises means for adding for each said car the forecast waiting time at said new hall call originating floor to said increment of the forecast waiting time, and means for selecting the car which provides a minimum sum thereby deciding said selected car to service said new hall call.

11. An elevator control system as claimed in claim 10, wherein there are further provided means for computing a forecast of the number of passengers in each said car at the successive floors to be serviced thereby in response to the application of signals including at least a signal representative of the number of passengers initially present therein and signals each representative of the number of passengers waiting at the already allotted floors, and means for setting the loading limit of the cars, and said servicing car selecting means further comprises means for comparing for each said car the number of predictive passengers at each of said floors with said loading limit, and means for selecting the car in which the number of predictive passengers at each said floor is less than said loading limit and which provides a minimum of the sum of said forecast waiting time and said increment thereby deciding said selected car to service said new hall call.

12. An elevator control system as claimed in claim 11, wherein said servicing car selecting means further comprises means for computing for each said car the number of predictive passengers at each of the already allotted floors when said new hall call is provisionally allotted thereto, means for comparing for each said car the number of predictive passengers at each said floor with said loading limit, and means for selecting the car in which the number of predictive passengers at each said floor is less than said loading limit and which provides a minimum of the sum of said forecast waiting time and increment thereby deciding said selected car to service said new hall call.

13. An elevator control system as claimed in claim 3, wherein said service condition computing means comprises means for computing a forecast of the number of passengers in each said car at each of the successive floors to be serviced thereby in response to the application of signals including at least a signal representative of the number of passengers initially present therein and signals each representative of the number of passengers waiting at the already allotted floors, and means for setting the loading limit of the cars, and said servicing car selecting means comprises means for computing a forecast for each said car of the change in the number of passengers therein at each of the already allotted floors when the new hall call is provisionally allotted thereto, and third means for comparing the number of predictive passengers at each said floor with the loading limit so as to determine the serviceability of said cars for said new hall call.

14. An elevator control system as claimed in claim 13, wherein said servicing cars selecting means further comprises means for computing a forecast for each said car of the number of passengers therein at said new hall call originating floor when said new hall call is provisionally allotted thereto, and fourth means for comparing for each said car the number of predictive passengers at said new hall call originating floor with said loading limit thereby determing the serviceability of said cars for said new hall call.

15. An elevator control system as claimed in claim 14, wherein there are further provided means for computing for each said car the forecast waiting time at each of the hall call originating floors, said servicing car selecting means further comprises means for finding the cars determined to be serviceable for said new hall call by said first, second, third and fourth serviceability determining means, and means for selecting the car which provides a minimum forecast waiting time at said new hall call originating floor among the cars found by said finding means thereby deciding said selected car to service said new hall call.

* * * * *